US007948346B2

(12) United States Patent
Hébert et al.

(10) Patent No.: US 7,948,346 B2
(45) Date of Patent: May 24, 2011

(54) PLANAR GROOVED POWER INDUCTOR STRUCTURE AND METHOD

(75) Inventors: Francois Hébert, San Mateo, CA (US); Tao Feng, Santa Clara, CA (US); Jun Lu, San Jose, CA (US)

(73) Assignee: Alpha & Omega Semiconductor, Ltd, Hamilton (BM)

( * ) Notice: Subject to any disclaimer, the term of this patent is extended or adjusted under 35 U.S.C. 154(b) by 0 days.

(21) Appl. No.: 12/165,423

(22) Filed: Jun. 30, 2008

(65) Prior Publication Data

US 2009/0322461 A1 Dec. 31, 2009

(51) Int. Cl.
*H01F 5/00* (2006.01)

(52) U.S. Cl. ..... 336/200

(58) Field of Classification Search ..... 336/65, 336/83, 200, 210, 212, 220–223, 232–234
See application file for complete search history.

(56) References Cited

U.S. PATENT DOCUMENTS

| | | | | |
|---|---|---|---|---|
| 4,543,553 | A | 9/1985 | Mandai et al. | |
| 5,032,815 | A | 7/1991 | Kobayashi et al. | |
| 5,111,169 | A * | 5/1992 | Ikeda | 333/181 |
| 6,380,834 | B1 * | 4/2002 | Canzano et al. | 336/200 |
| 6,630,881 | B1 | 10/2003 | Takeuchi et al. | |
| 6,930,584 | B2 * | 8/2005 | Edo et al. | 336/200 |
| 7,046,114 | B2 | 5/2006 | Sakata | |
| 7,268,659 | B2 | 9/2007 | Nishio et al. | |
| 7,299,537 | B2 | 11/2007 | Gardner | |
| 7,436,280 | B2 * | 10/2008 | Jedlitschka | 336/200 |
| 7,489,223 | B2 * | 2/2009 | Yokoyama et al. | 336/200 |

OTHER PUBLICATIONS

U.S. Appl. No. 12/011,489 entitled "Lead frame-based discrete power inductor" filed Jan. 25, 2008.
Notice of Allowance dated Mar. 18, 2011 for U.S. Appl. No. 13/007,551.
U.S. Appl. No. 13/007,551, filed Jan. 14, 2011; inventors Francois Hebert, Tao Feng, Jun Lu.

* cited by examiner

*Primary Examiner* — Tuyen Nguyen
(74) *Attorney, Agent, or Firm* — JDI Patent; Joshua D. Isenberg

(57) ABSTRACT

An inductor may include a planar ferrite core. A first group of one or more grooves is formed in a first side of the ferrite core. A second group of two or more grooves is formed in a second side of the ferrite core. The grooves in the first and second groups are oriented such that each groove in the first group overlaps with two corresponding grooves in the second group. A first plurality of vias communicates through the ferrite core between the first and second sides of the ferrite core. Each via is located where a groove in the first group overlaps with a groove in the second group. A conductive material is disposed in the first and second groups of grooves and in the vias to form an inductor coil.

17 Claims, 23 Drawing Sheets

100
105
102
B
B'
104
105
103
106
C
C'

104
102
Section B-B'

108
105
102
104
Section C-C'

108
105
102
104
E
E'
107

104
107
108
102
Section E-E'

300
104
102
B
B'
103
106
105
C
C'

104
102
Section B-B'

108
104
102
Section C-C'

108
102
104
107
E
E'
F
F'
106

104
102
Section E-E'

108
102
Section F-F'

104
108

600

610

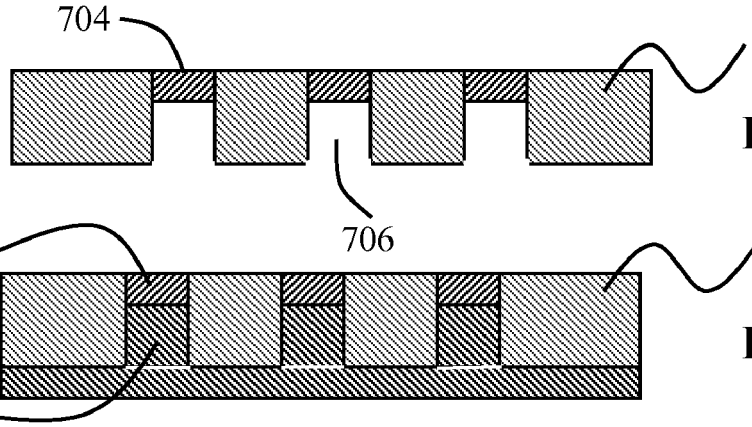
FIG. 7G
FIG. 7H
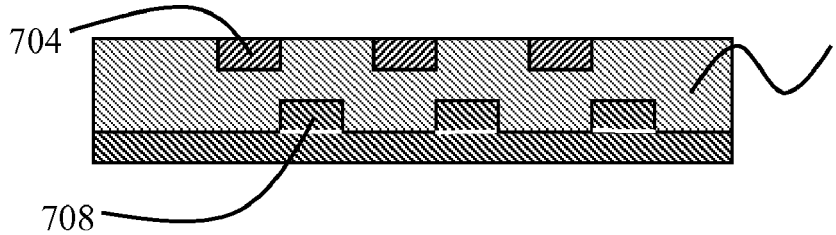
FIG. 7I
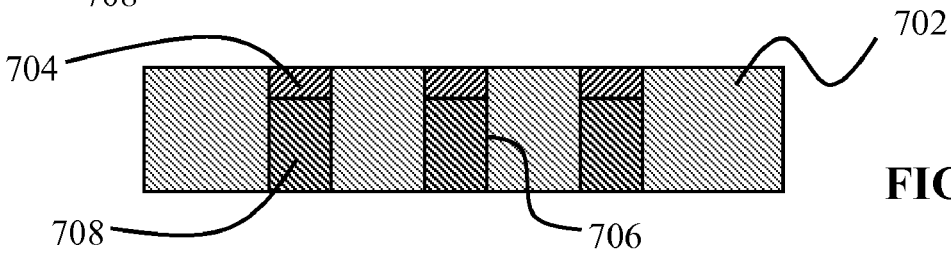
FIG. 7J
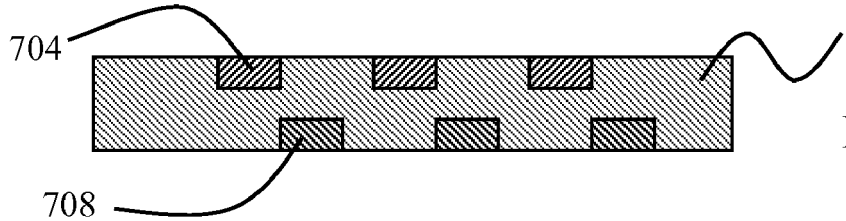
FIG. 7K
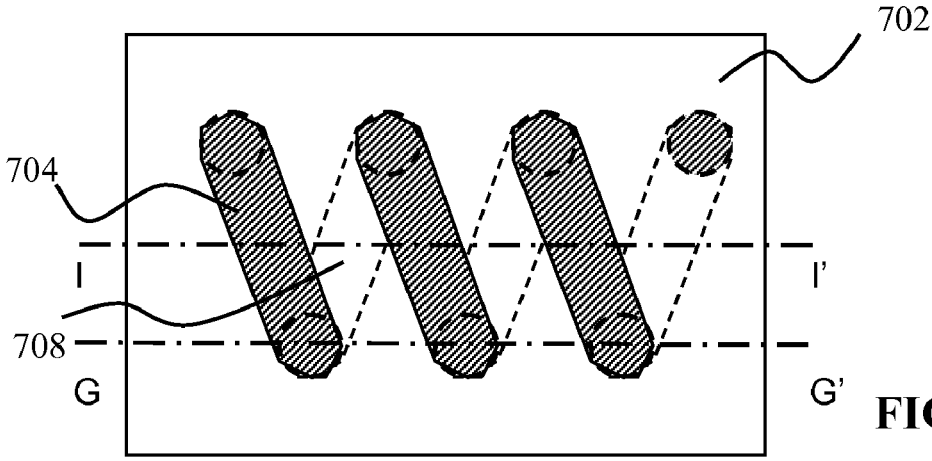
FIG. 7L

906

PLANAR GROOVED POWER INDUCTOR STRUCTURE AND METHOD

FIELD OF THE INVENTION

This invention generally relates to discrete power inductor and more particularly to low-cost and ultra-small discrete power inductors.

BACKGROUND OF THE INVENTION

In recent years, electronic information equipment, especially various portable types of electronic information equipment, have become remarkably widespread. Most types of electronic information equipment use batteries as power sources and include built-in power converters such as DC-DC converters. In general, a power converter is constructed as a hybrid module in which individual parts of active components, such as switching elements, rectifiers and control ICs, and passive elements, such as inductors, transformers, capacitors and resistors, are located on a ceramic board or a printed board of plastic or similar material. In recent years, the miniaturization of inductors has been an issue in miniaturization of power converters.

An inductor generally includes wire wound around a core of ferrite material. Power inductors operate as energy-storage devices that store energy in a magnetic field during the power supply's switching-cycle on time and deliver that energy to a load during off time. There are different types of power inductors, including discrete wire-wound inductors, discrete surface-mount (SMD) inductors, discrete non-wire wound (e.g., solenoid type) inductors and discrete multi-layer inductors. Wire-wound inductors may be based on round wire or flat wires, wound around a ferrite core, with encapsulation. Examples of wire-wound inductors include those made by TOKO. Discrete SMD inductors include wire wound around a magnetic core with the resulting structure being coated with a resin. Taiyo-Yuden's inductors are examples of surface-mount inductors.

"Open Spools" are often used to enable the winding of the wire conductors which form inductor coils. However, winding wire is not the most efficient process to form a toroidal coil. Typical toroidal coil inductors require "feeding" of the wire through a center hole in a doughnut shaped ferrite core, which is a complex process to automate.

Multilayer inductors include multiple layers of ferrite, each with a pattern of conductive material (Ag for example) that forms part of the inductor coils. The ferrite layers are stacked and conductive vias between adjacent layers connect the patterned conductors to form the coils.

U.S. Pat. No. 6,930,584 discloses a microminiature power converter including a semiconductor substrate on which a semiconductor integrated circuit is formed, a thin film magnetic induction element, and a capacitor. The thin film magnetic induction element includes a magnetic insulating substrate, which may be a ferrite substrate, and a solenoid coil conductor in which a first set of conductors is formed on a first principal plane of the magnetic insulating substrate, a second set of conductors is formed on a second principal plane of the magnetic insulating substrate, a set of conductive connections is formed in through holes passing through the magnetic insulating substrate providing electrical connection between the first and second set of conductors and forming the inductor coils, and a set of conductive connections formed in through holes passing through the magnetic insulating substrate providing electrodes electrically connected through the through hole. A surface of the coil conductor may be covered with an insulating film or a resin in which magnetic fine particles are dispersed. However, the thickness of the inductor coil conductors is limited to the thickness of the conductive layer deposited on the magnetic insulating substrate.

U.S. Pat. No. 6,630,881 discloses a multi-layered chip inductor including coil-shaped internal conductors formed inside a green ceramic laminate. Each of the coil-shaped internal conductors spirals around an axial line in the laminating direction of the green ceramic laminate. An external electrode paste is applied onto at least one laminating-direction surface of the green ceramic laminate, which external electrode paste connects to an end of the coil-shaped internal conductor. The green ceramic laminate is cut along the laminating direction into chip-shaped-green ceramic laminates each having the coil-shaped internal conductor inside.

U.S. Pat. No. 4,543,553 discloses a chip-type inductor comprising a laminated structure of a plurality of magnetic layers in which linear conductive patterns extending between the respective magnetic layers are connected successively in a form similar to a coil so as to produce an inductance component. The conductive patterns formed on the upper surfaces of the magnetic layers and the conductive patterns formed on the lower surfaces of the magnetic layers are connected with each other in the interfaces of the magnetic layers and are also connected to each other via through-holes formed in the magnetic layers, so that the conductive patterns are continuously connected in a form similar to a coil.

U.S. Pat. No. 7,046,114 discloses a laminated inductor including ceramic sheets provided with spiral coil conductor patterns of one turn, ceramic sheets provided with spiral coil conductor patterns of two turns, and ceramic sheets provided with lead-out conductor patterns, which are laminated together. The coil conductor patterns are successively electrically connected in series in regular order through via holes. The via holes are disposed at fixed locations in the ceramic sheets.

U.S. Pat. No. 5,032,815 discloses a lamination type inductor having a plurality of ferrite sheets assembled one above the other and laminated together. The uppermost and lowermost sheets are end sheets having lead-out conductor patterns facing each other. A plurality of intermediate ferrite sheet each has a conductor pattern on one surface which corresponds to a 0.25 turn of an inductor coil and a conductor pattern on the other surface which corresponds to a 0.5 turn of an inductor coil. Each ferrite sheet has an opening through which the conductor patterns of the 0.25 and 0.5 turn are electrically connected to form a 0.75 turn of an inductor coil on each ferrite sheet. The conductor patterns on the successive intermediate sheets are connected to each other for forming an inductor coil having a number of turns, which is a multiple of 0.75, and the conductor patterns on the upper surface of the uppermost of the plurality of intermediate ferrite sheets and the lower surface of the lowermost of the intermediate ferrite sheets are electrically connected to the conductor patterns on the surfaces of the end sheets for forming a complete inductor coil.

U.S. patent application Ser. No. 12/011,489 of Alpha & Omega Semiconductor LTD discloses an inductor comprising a toroid magnetic core with lead frame conductors having low resistance, but not planar since lead frames are placed on top and bottom of the magnetic core substrate Many conventional power inductors are not planar, have relatively high resistance due to the limited thickness (size) of the inductor conductors, do not have a completely closed magnetic loop or do not incorporate a means of connecting other components in a stacked configuration (which minimizes the overall area).

It would be desirable to develop a power inductor structure which maximizes the inductance per unit area and minimizes resistance by using low-resistivity conductor and appropriate assembly techniques, in combination with the lowest number of turns, and small physical size.

It would be further desirable to produce a device that enables small foot print and thin outline with high-volumes and a low-cost of manufacture.

It is within this context that embodiments of the present invention arise.

BRIEF DESCRIPTION OF THE DRAWINGS

Objects and advantages of the invention will become apparent upon reading the following detailed description and upon reference to the accompanying drawings in which:

FIGS. 7A-7B, 7D-7K are cross-sectional views illustrating a method for manufacturing a power inductor of the type depicted in FIG. 1A.

FIG. 7L is a transparent top view of the completed power inductor.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Figures 1A, 1B, 1C, 1D, 1E:
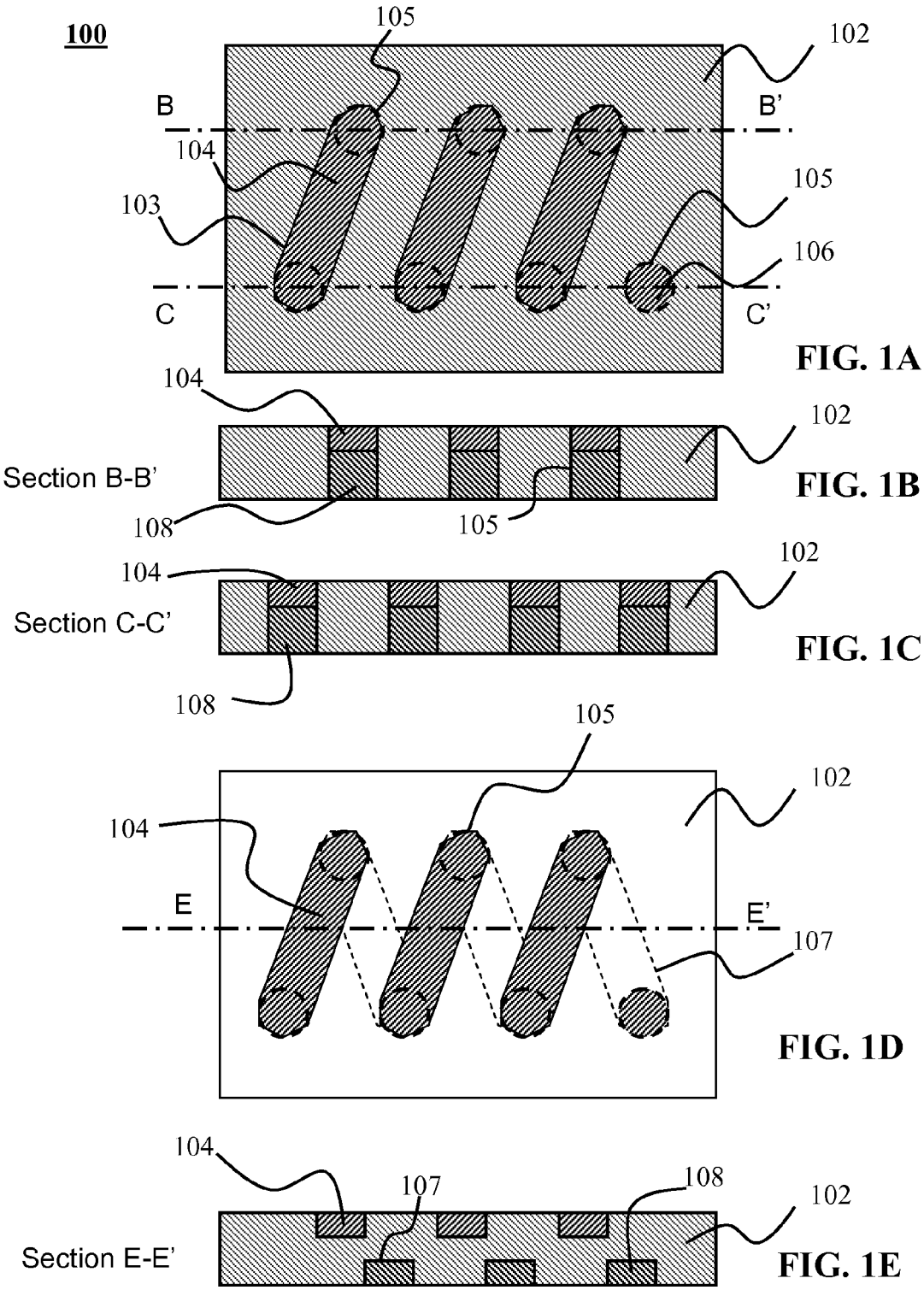
FIG. 1A is a top view of a discrete power inductor according to an embodiment of the present invention.
FIG. 1B is a cross-sectional view of the power inductor of FIG. 1A along line B-B' respectively.
FIG. 1C is a cross-sectional view of the power inductor of FIG. 1A along line C-C'.
FIG. 1D is a transparent top view of the power inductor of FIG. 1A.
FIG. 1E is a cross-sectional view of the power inductor of FIG. 1A along line E-E' of FIG. 1D.
Figure 2A:
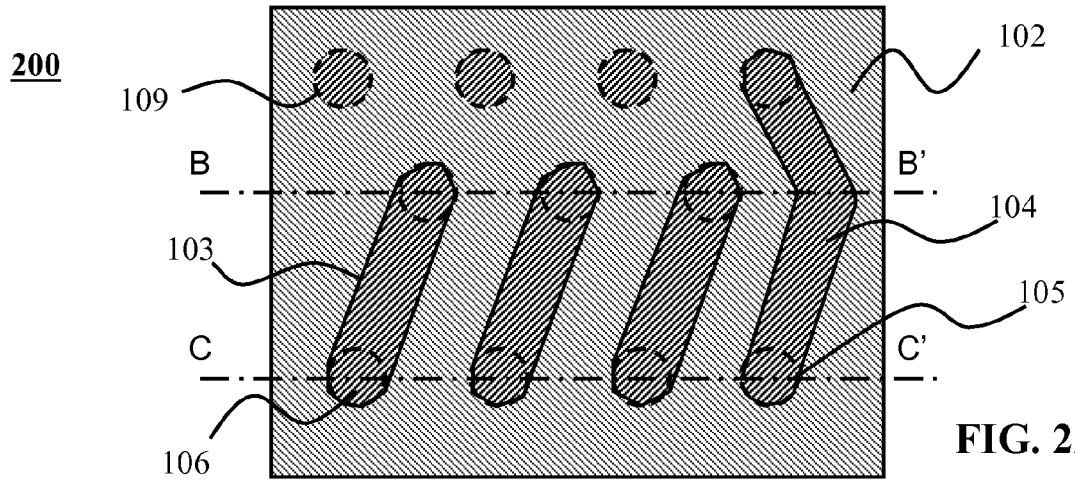
FIG. 2A is a top view of a discrete power inductor according to another embodiment of the present invention.
Figure 2B:
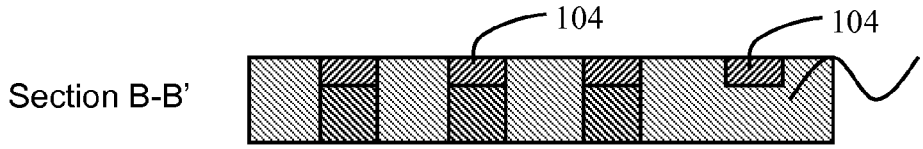
FIGS. 2B-2C are cross-sectional views of the power inductor of FIG. 2A along lines B-B' and C-C' respectively.
Figure 2C:
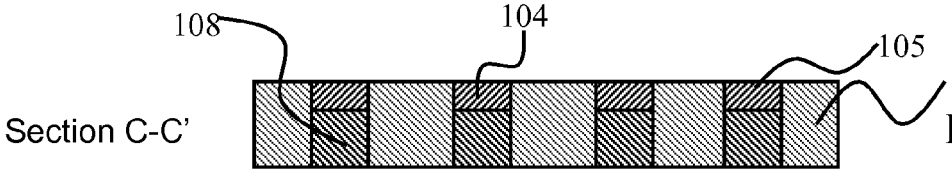
Figure 2D:
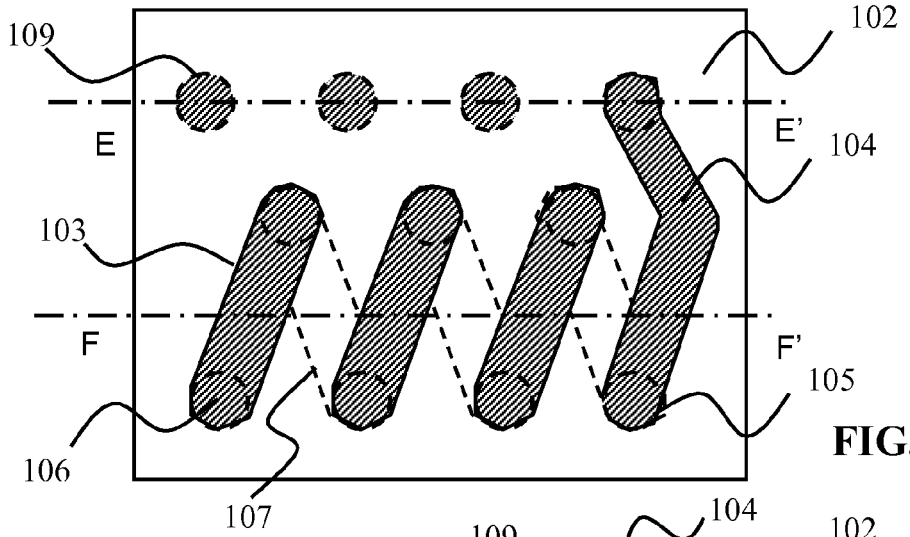
FIG. 2D is a transparent top view of the power inductor of FIG. 2A.
Figure 2E:
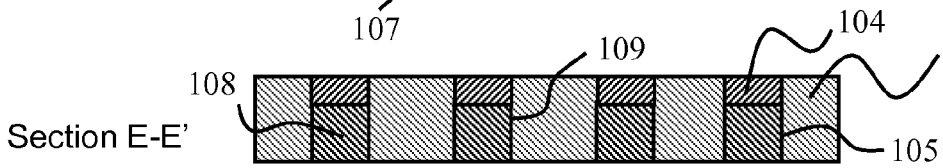
FIGS. 2E-2F are cross-sectional views of the power inductor of FIG. 2A along line E-E' and F-F', respectively, of FIG. 2D.
Figure 2F:
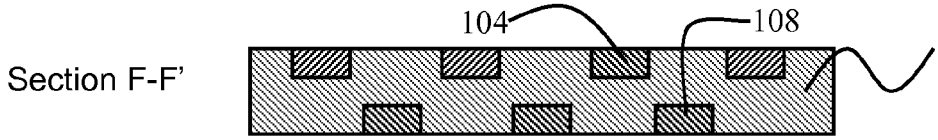

As shown in FIGS. 1A-1E, a discrete power inductor 100 according to an embodiment of the present invention may include a ferrite core in the form of a single ferrite layer 102 with a pattern of one or more parallel grooves 103 on its top surface, which are filled with conductive material 104 to form a set of top electrodes. The inductor 100 also includes patterned grooves 107 on its bottom surface, which are filled with conductive material 108 to form bottom electrodes as shown in FIG. 1D. The inductor 100 also includes through vias 105 filled with conductive material 106, which electrically connect the top conductive material 104 and bottom conductive material 108 to form an inductor coil. The conductive material 106 in the via 105 may be formed from the top and bottom conductive material 104, 108. The locations of the vias are indicated by dashed lines. In transparent top views such as FIG. 1D, the positions of the bottom grooves are also indicated by dashed lines. Each of the top grooves 103 and bottom grooves 107 may begin at one via and end at another via. Such grooves may be formed, e.g., by lithographic patterning and etching. Examples of suitable ferrite materials adequate for power inductors at high-frequencies (>1 MHz for example) include NiZn, NiCo, MnZn, MnNiZn, among others.

As may be seen in the cross-sectional views depicted in FIGS. 1B-1C and FIG. 1E and the transparent view depicted in FIG. 1D, the vias 105 are located at positions where the top surface grooves 103 overlaps with the bottom surface grooves 107 in order to connect the two grooves. There may be vias formed at the ends of the coils to allow contact to both ends to be made on a single surface (top or bottom). The bottom surface grooves 107 are angled with respect to the top surface grooves 103. The angling of the bottom and top surface grooves 103, 107 and the positioning of the vias 105 produces an inductor coil when the grooves 103, 107 and vias 105 are filled with the conductive materials 104, 108.

As may also be seen in the cross-sectional views depicted in FIGS. 1B-1C and FIG. 1E, the inductor 100 is planar. The conductive material 104, 108 in the top and bottom grooves 103, 107 does not extend outside the plane of the ferrite core's surfaces.

Many advantages to such a planar inductor configuration may clearly seen. The planar structure of the inductor allows the inductor to be easily stackable. The thickness of the inductor is a function of the groove depth. By forming grooves of a sufficient depth, and vias of a sufficient diameter, the inductor can achieve ultra-low resistance. Also, the vias, which connect the top and bottom sides of the inductor coil, may be formed away from the edges of the ferrite substrate, which allows the ferrite material to form a closed magnetic loop around the inductor coils. A closed magnetic loop greatly increases the inductance per unit area.

FIGS. 2A-2F illustrate a discrete power inductor 200 according to another embodiment of the present invention. Similar to the inductor 100, the inductor 200 includes a ferrite core in the form of a single ferrite layer 102 with patterned grooves 103, 107 on its top and bottom surfaces, which are filled with conductive materials 104, 108 to form top and bottom conductors that are electrically connected by through vias 105 filled with conductive material 106 to form the inductor coil. The conductive material 106 in the vias 105 may be formed from the top and bottom conductive material 104, 108. In this embodiment, the inductor 200 also includes additional through vias 109 filled with conductive material that may be used to provide electrical connection to other similarly configured dies, which may be stacked. Similarly to the conductive material 106 in the vias 105, the conductive material in the additional through vias 109 can be formed from the top groove conductive material 104, and the bottom groove conductive material 108.

By way of example, an IC chip can be stacked on top of the inductor 200, with the additional through vias 109 providing electrical routing from the IC chip to the bottom of the inductor 200. The stacked IC chip with inductor 200 can be mounted on a circuit board with all the necessary electrical routing available on the bottom of the inductor 200. Again, the planar structure of the inductor allows for stacking to be easily accomplished.

Figures 3A, 3B, 3C, 3D, 3E, 3F:
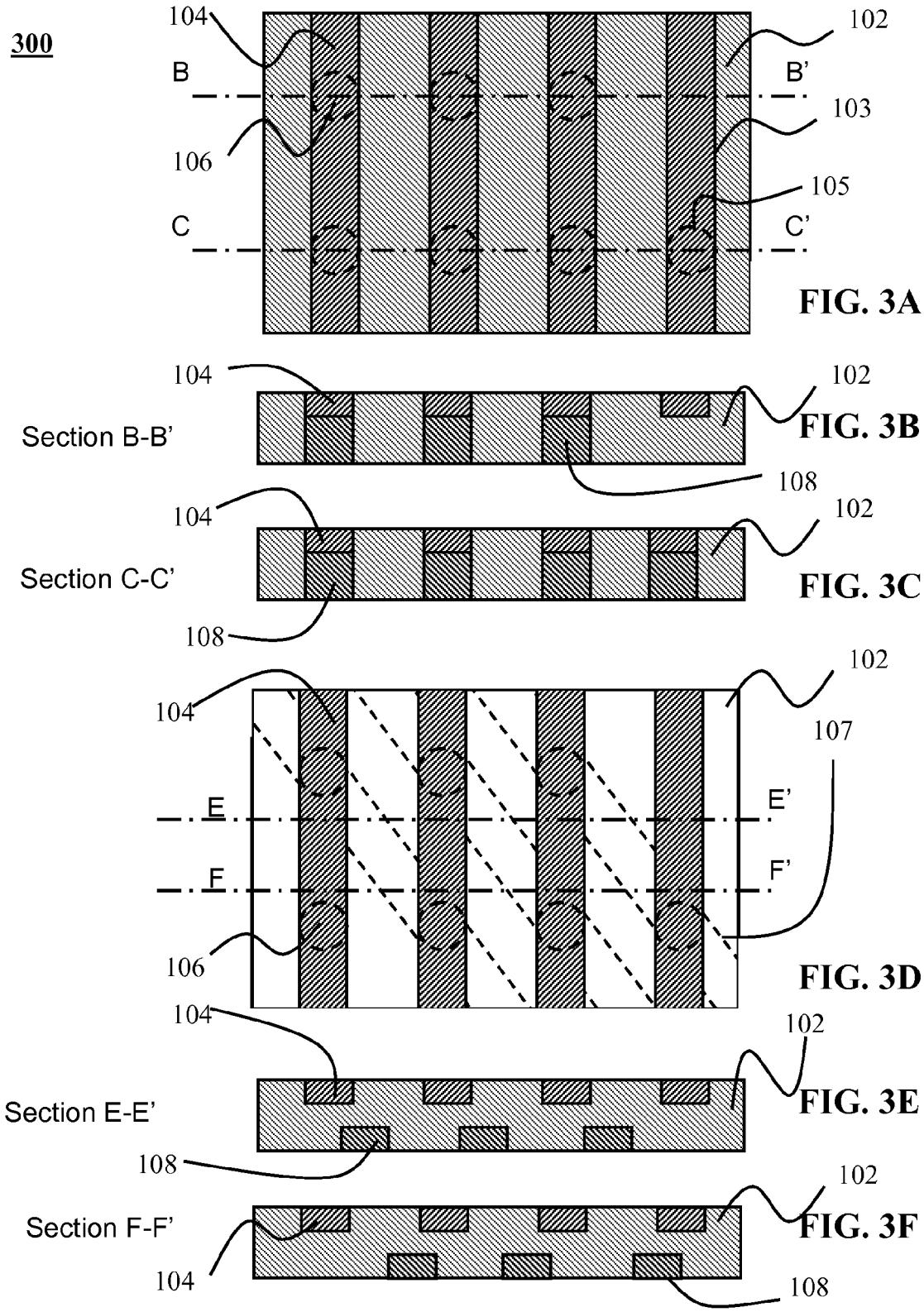
FIG. 3A is a top view of a discrete power inductor according to another embodiment of the present invention.
FIGS. 3B-3C are cross-sectional views of the power inductor of FIG. 3A along line B-B' and C-C' respectively.
FIG. 3D is a transparent top view of the power inductor of FIG. 3A.
FIGS. 3E-3F are cross-sectional views of the power inductor of FIG. 3A along line E-E' and F-F', respectively, of FIG. 3D.

FIGS. 3A-3F shows a discrete power inductor 300 according to an embodiment of the present invention. In this embodiment, the inductor 300 includes a ferrite core in the form of a single ferrite layer 102 with grooves 103 and 107, filled with conductive material 104 and 108 that extend across the top and bottom surfaces between the side edges of the ferrite layer 102. Such grooves may be formed, e.g., using shallow saw cuts (SSC) along top and bottom surfaces of single ferrite layer 102. The bottom grooves 107 on its bottom surface are angled with respect to the top grooves 103 as shown in FIG. 3D. The inductor 300 also includes through vias 105 filled with conductive material 106, which connect the top and bottom groove regions 104 and 108 to form the inductor coil. To form the coil, selected vias 105 may be located at places where the top and bottom grooves 103, 107 overlap, as seen in FIG. 3D.

Figure 4A:
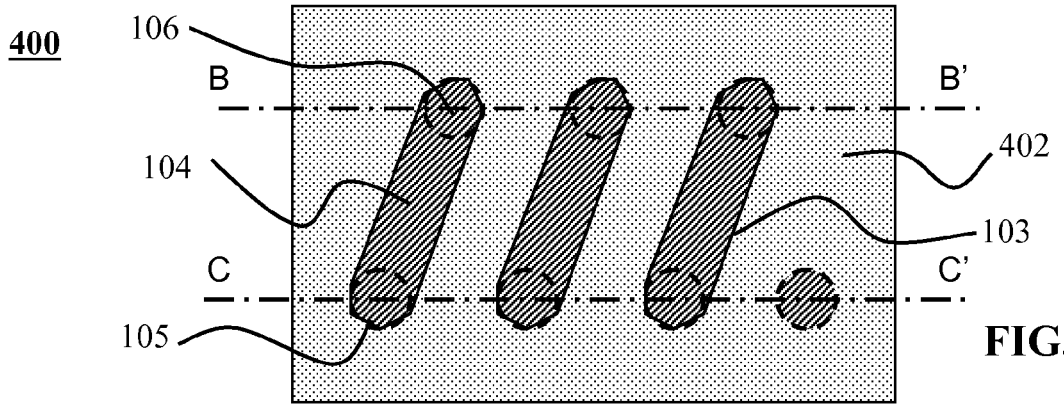
FIG. 4A is a top view of a discrete power inductor according to another embodiment of the present invention.
Figure 4B:
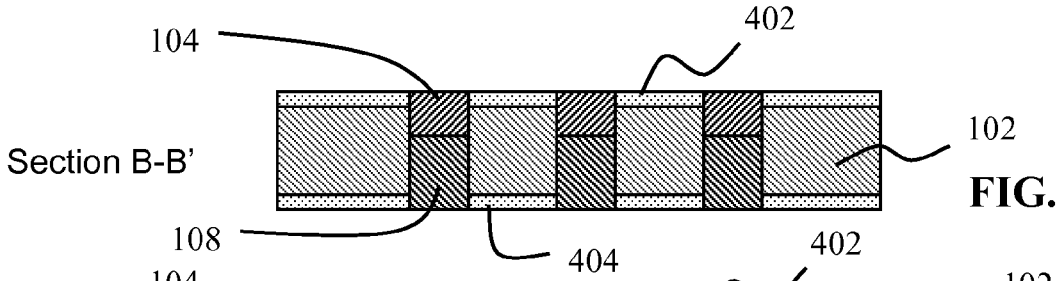
FIGS. 4B-4C are cross-sectional views of the power inductor of FIG. 4A along line B-B' and C-C' respectively.
Figure 4C:
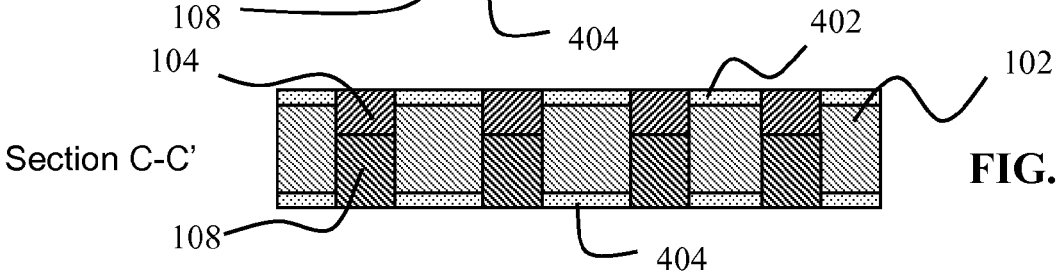
Figure 4D:
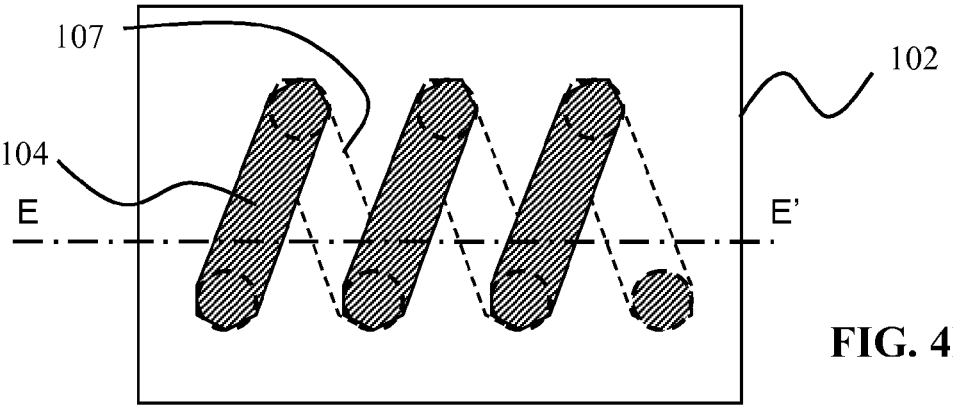
FIG. 4D is a transparently top view of the power inductor of FIG. 4A.
Figure 4E:
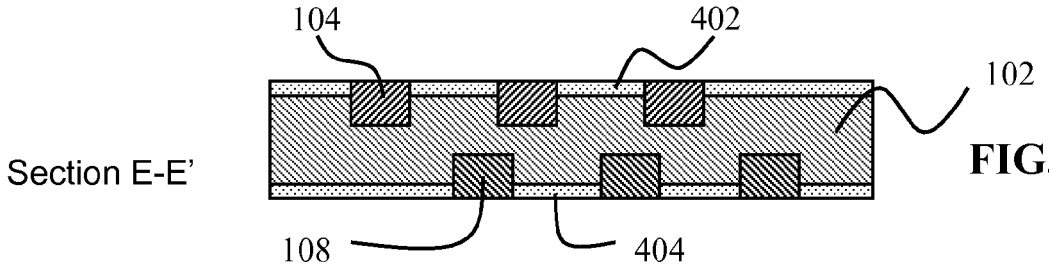
FIG. 4E is a cross-sectional view of the power inductor of FIG. 4A along line E-E' of FIG. 4D.

FIGS. 4A-4E illustrate a discrete power inductor 400 according to another embodiment of the present invention. The structure of the inductor 400 is similar with the structure of the inductor 100 as described above in FIG. 1, which includes a single ferrite layer 102 with patterned grooves 103 on it top surface, which are filled with conductive material 104 to form top electrodes, and patterned grooves 107 on its bottom surface, which are also filled with conductive material 108 to form bottom electrodes as shown in FIG. 4D. The inductor 400 also includes through vias 105 filled with conductive material 106, which connect the top and bottom etched groove regions 104 and 108 to form the inductor coil, e.g., as described above.

In this embodiment, the top and bottom surfaces of the single ferrite layer 102 are passivated with dielectric layers 402 and 404 prior to patterned groove formation as shown in FIG. 4B and FIG. 4C, which are cross-sectional views along lines B-B' and C-C' of the inductor 400 depicted in FIG. 4A. The top and bottom dielectric layers 402, 404 can be used as hard masks during etching of the grooves and/or vias, to passivate a porous magnetic material used in the ferrite layer 102.

Figure 5A:
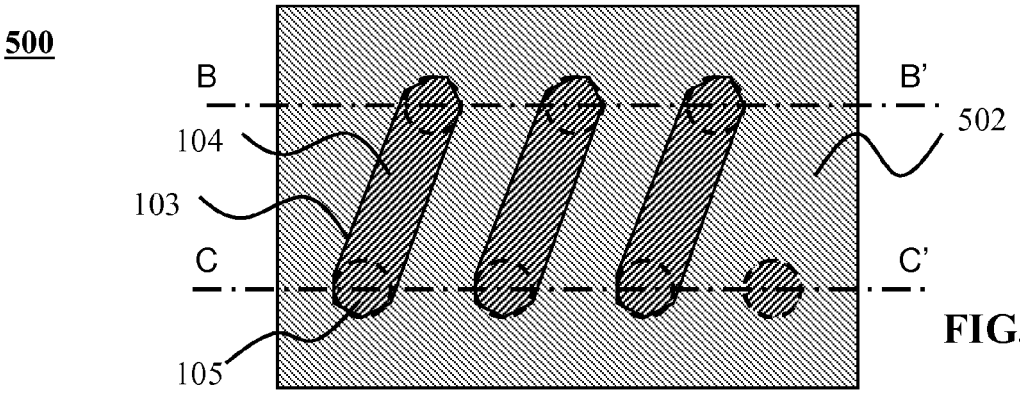
FIG. 5A is a top view of a discrete power inductor according to another embodiment of the present invention.
Figure 5B:
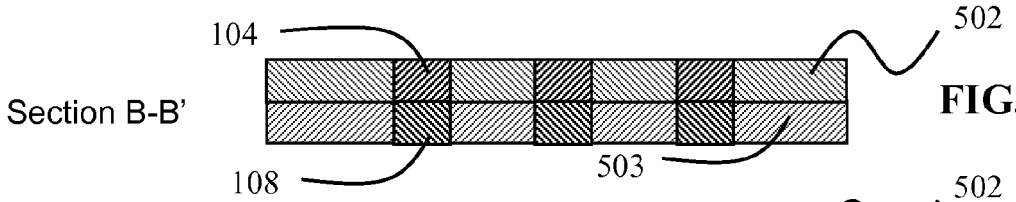
FIGS. 5B-5C are cross-sectional views of the power inductor of FIG. 5A along line B-B' and C-C' respectively.
Figure 5C:
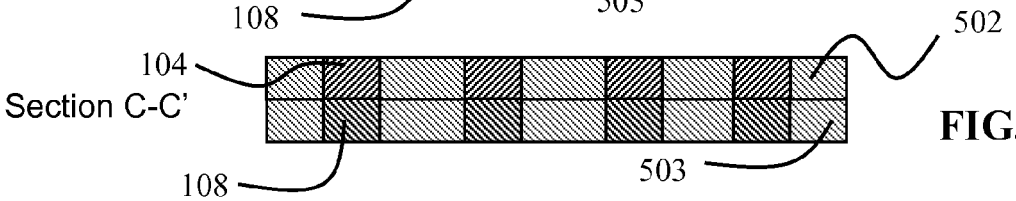
Figure 5D:
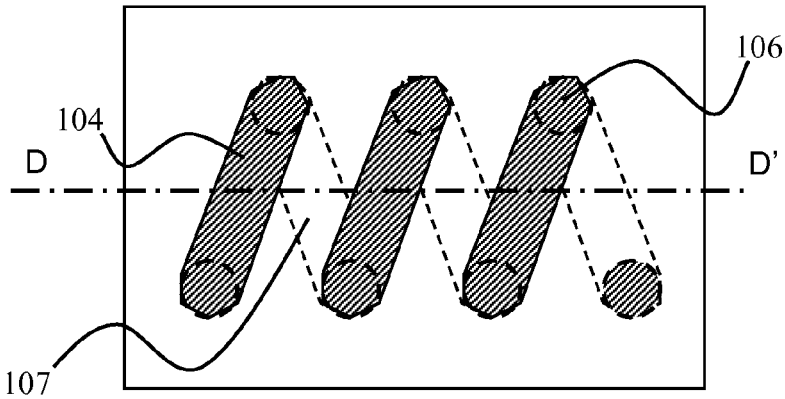
FIG. 5D is a transparently top view of the power inductor of FIG. 5A.

FIGS. 5A-5F illustrate a discrete power inductor 500 according to another embodiment of the present invention. In this embodiment, the inductor 500 includes ferrite core made from first and second ferrite layers 502, 503 with patterned grooves 103 formed on a top surface of the first ferrite layer 502, and patterned grooves 107 formed on a bottom surface of the second ferrite layer 503 as shown in FIGS. 5B-5C, which are cross-sectional views along lines B-B' and C-C' respectively of the inductor 500 depicted in FIG. 5A. Grooves 103 and 107 are filled with conductive materials 104, 108 to form top and bottom electrodes as shown in FIG. 5D. The inductor 500 also includes through vias 105 filled with conductive material 106, which connect the top and bottom etched groove regions 104 and 108 to form the inductor coil.

Figure 5E:
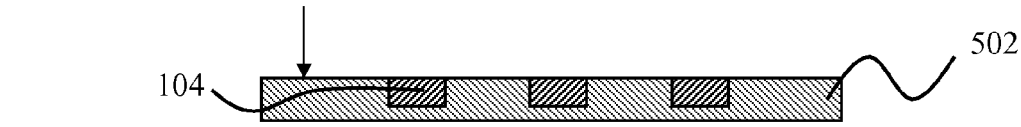
FIGS. 5E-5F are cross-sectional views of the power inductor of FIG. 5A along line D-D'.
Figure 5F:
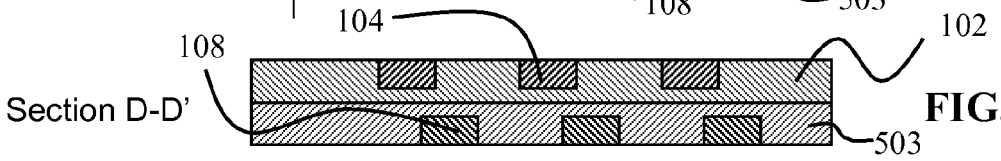

As seen in FIG. 5E, which is a cross-sectional view along line D-D' of the inductor 500 depicted in FIG. 5D, the grooves 103, 107 may be formed in the two separate ferrite layer 502 and 503 respectively and filled with the conductive materials 104, 108. Subsequently, the ferrite layers may be stacked together back-to-back to form the inductor 500 as shown in FIG. 5F.

Figure 6A:
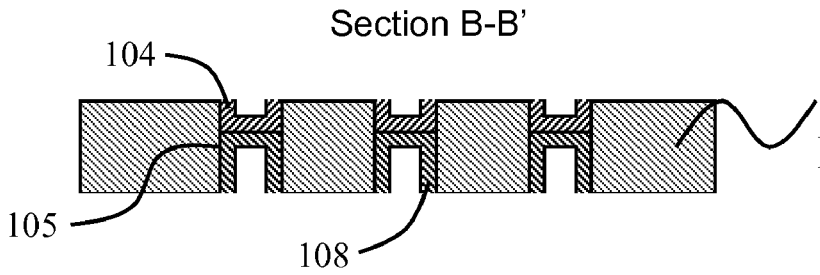
FIGS. 6A-6D are cross-sectional views of power inductors according to alternative embodiments of the present invention.
Figure 6B:
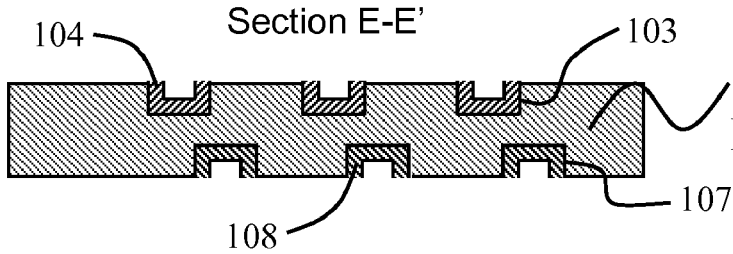

FIGS. 6A-6B are cross-sectional views of an inductor 600 according to an alternative embodiment of the present invention. The structure of inductor 600 may be similar to the structure of the inductors 100, 200, and 300 as described above in FIGS. 1A-1E, FIGS. 2A-2F and 3A-3F respectively except that the grooves 103 and 107 are partially filled with conductive materials 104, 108 to form the inductor coils. The conductive materials 104, 108 line the sidewalls and bottoms of the grooves 103, 107. The conductive materials 104, 108 line the sidewalls of the vias 105 and converge together. The structure of the inductor 600 remains planar with respect to the surface of the magnetic core substrate. The cross section shown in FIG. 6A corresponds to a sectional view along lines B-B' in FIG. 1A. The cross section shown in FIG. 6B corresponds to a sectional view along lines E-E' in FIG. 1D.

Figure 6C:
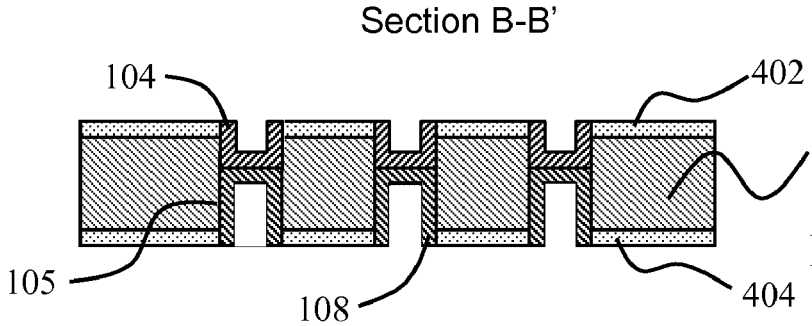
Figure 6D:
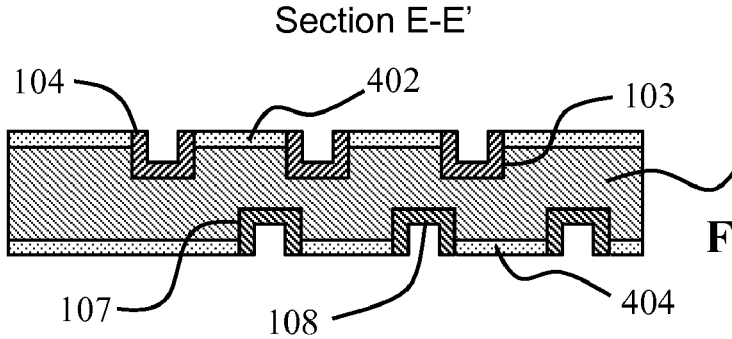

FIGS. 6C-6D are cross-sectional views of an inductor 610 according to an embodiment of the present invention. The structure of inductor 610 is similar to that of the inductor 400, as described above in FIG. 4A-4E except that the grooves 103 and 107 are partially filled with conductive materials 104, 108 to form the inductor coils. The conductive materials 104, 108 line the sidewalls of the vias 105 and converge together. The structure of the inductor 610 remains planar with respect to the surface of the magnetic core substrate. The cross section shown in FIG. 6A corresponds to a sectional view along lines B-B' in FIG. 4A. The cross section shown in FIG. 6B corresponds to a sectional view along lines E-E' in FIG. 4D. In this embodiment, the top and bottom surfaces of the single ferrite layer 102 are passivated with dielectric layers 402 and 404 prior to groove formation.

Figure 7A:
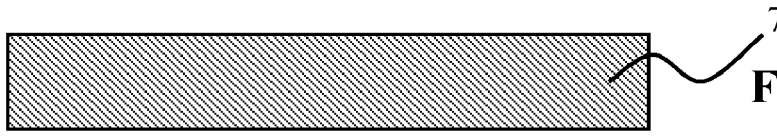
Figure 7B:
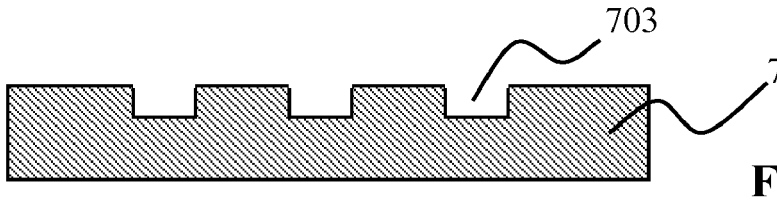
Figure 7C:
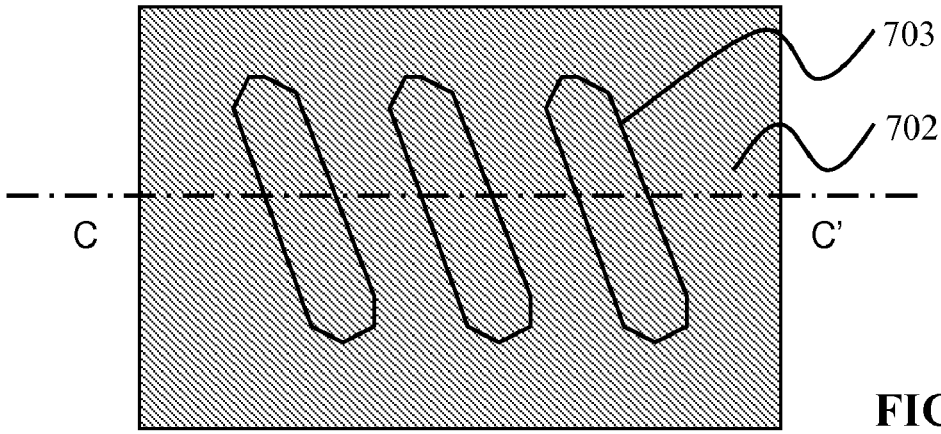
FIG. 7C is a top view of the partially completed structure depicted in FIG. 7B.

FIGS. 7A-7B, 7D-7G and 7I-7K are cross-sectional views illustrating a method for manufacturing a power inductor with complete fill of the grooves with conductive material of the type depicted in FIGS. 1A-1E. FIG. 7L is a transparent top view of a complete inductor of the type depicted in FIG. 1A-1E. As shown in FIG. 7A, a magnetic core substrate 702 is provided. Preferably, the substrate 702 is a ferrite optimized for high frequency, such as NiZn and the like. A resist mask deposited and patterned on the top surface of the substrate 702. Portions at the top surface of the substrate 702 are dry etched or sputter etched through openings in the pattern to form grooves 703 as shown in FIG. 7B. The resist mask is then stripped. FIG. 7C shows a top view of the resulting structure depicted in FIG. 7B. The cross-sections in FIGS. 7A-7B and 7D-7F are taken along line C-C' of FIG. 7C, at different stages of the manufacturing process.

Figure 7D:
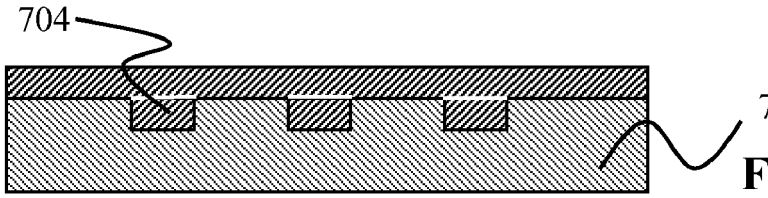
Figure 7E:
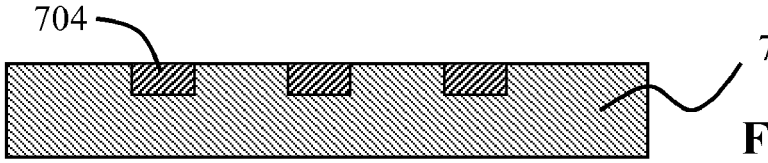

Conductive material 704, for example a metal such as W, copper, Al, Ag and the like, is then deposited on top of the substrate 702, e.g., by a vapor deposition technique, such as chemical vapor deposition (CVD) or physical vapor deposition (PVD). The conductive material 704 completely filled the grooves 703 as shown in FIG. 7D. The excess conductive material 704 is etched back, e.g., using dry etching or chemical mechanical polishing (CMP) to planarize the surface and expose the ferrite surfaces away from the metal-filled grooves, as shown in FIG. 7E.

Figure 7F:
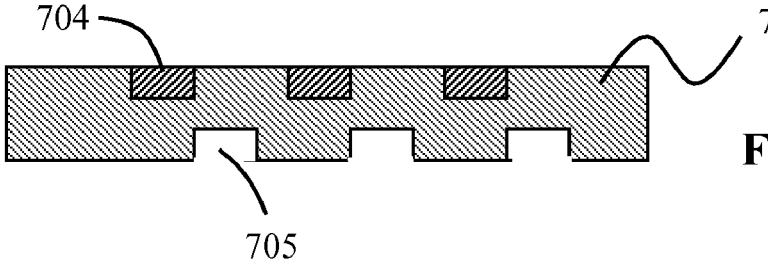

The fabrication sequence carried out on the top surface of the substrate 702 may be repeated on the bottom surface. Specifically, the substrate 702 may be flipped over, and a resist mask deposited and patterned on the bottom surface of the substrate 702. Portions of the bottom surface of the substrate 702 are dry etched or sputter etched through openings in the mask pattern to form grooves 705 as shown in FIG. 7F. The resist mask is then stripped.

Vias 706 are patterned and etched on the bottom surface of the substrate 702 at locations where the top and bottom grooves overlap, and at the ends of the inductor coil which is formed when filled with conductive materials 704, 708. The vias may be formed, e.g., by etching through the substrate down to the conductive material 704 of the top surface as shown in FIG. 7G. The cross-section in FIG. 7G is taken along line G-G' of FIG. 7L, which depicts the completed device.

Conductive material 708 is deposited on the bottom surface of the substrate 702, completely filling the grooves 705 and vias 706 as shown in FIGS. 7H-7I. The cross-section in FIG. 7H is taken along line G-G' of FIG. 7L. The cross-section in FIG. 7I is taken along line I-I' of FIG. 7L. The conductive material 708 is etched back using dry etching back or chemical mechanical polishing (CMP) to planarize the surface and expose the ferrite surfaces away from the metal-filled grooves as shown in FIGS. 7J-7K. The cross-section in FIG. 7J is taken along line G-G' of FIG. 7L. The cross-section in FIG. 7K is taken along line I-I' of FIG. 7L.

In some embodiments, the completed device may be subjected to an optional annealing step to help reduce the contact resistance between layers. For example, the completed device may be heated to a temperature between 300° C. and 500° C. in an inert gas, such as nitrogen or a forming gas, e.g., 4 to 10% Hydrogen in Nitrogen.

Figure 8A:
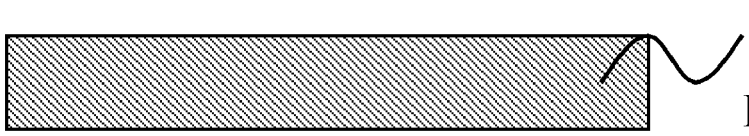
FIGS. 8A-8F and 8H-8K are cross-sectional views illustrating a method for manufacturing a power inductor of the type depicted in FIGS. 6A-6B.
Figure 8B:
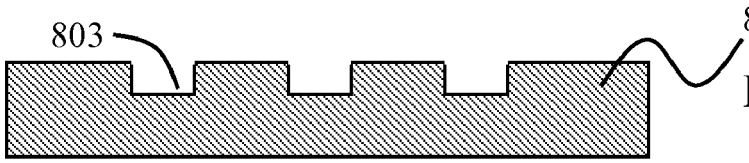
Figure 8C:
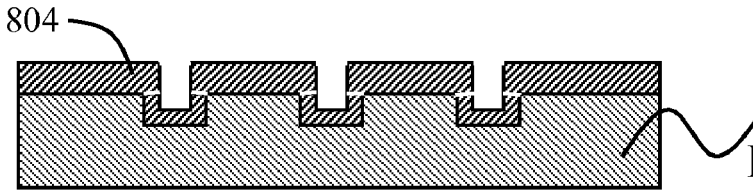
Figure 8D:
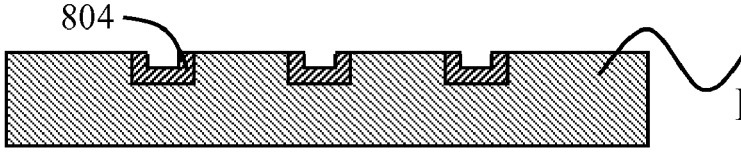
Figure 8E:
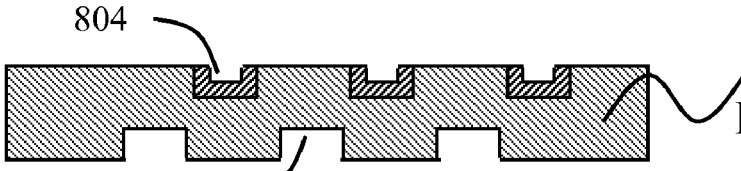

FIGS. 8A-8F and 8H-8K are cross-sectional views illustrating a method for manufacturing a power inductor with partial fill of the grooves with conductive material of the type depicted in FIGS. 6A-6B. FIG. 8G shows a top view of the inductor structure in a partially completed state of fabrication. FIG. 8L is a transparent top view of a completed structure of the inductors of the type depicted in FIGS. 6A-6B. The cross-sections in FIGS. 8A-8D and 8F are taken along line B-B' of FIG. 8G. The cross-section in FIG. 8E is taken along line F-F' of FIG. 8G. As shown in FIG. 8A, a magnetic core substrate 802 is provided, which is preferably a ferrite optimized for high frequency, such as NiZn and the like. A resist mask is deposited and patterned on the top surface of the substrate 802. Portions of the top surface of the substrate 802 are dry etched or sputter etched to form grooves 803 as shown in FIG. 8B. The resist mask is then stripped.

Conductive material 804, for example metal such as tungsten, copper, aluminum, silver and the like, is then deposited on top of the substrate 802 in a way that partially fills the grooves 803 as shown in FIG. 8C. The conductive material 804 is etched back using dry etching back or chemical mechanical polishing (CMP) to planarize the surface (and expose the ferrite material away from the grooves) as shown in FIG. 8D.

The substrate is flipped over, and a resist mask is deposited and patterned on the bottom surface of the substrate 802. Portions at the bottom surface of the substrate 802 are dry etched or sputter etched to form grooves 805 as shown in FIG. 8E. The resist mask is then stripped.

Figure 8F:
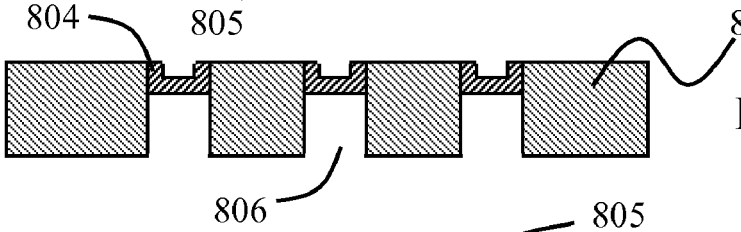
Figure 8G:
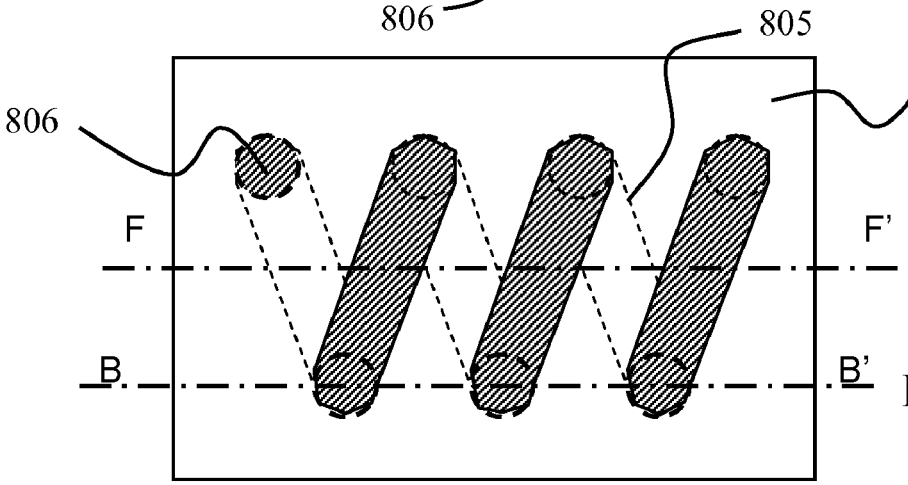
FIG. 8G is a top view of the partially completed structure depicted in FIG. 8F.

Vias 806 are patterned on the bottom surface of the substrate 802 and are formed by etching down to the conductive material 804 of the top surface as shown in FIG. 8F. FIG. 8G is a transparent top view of the partially completed structure at the stage depicted in FIG. 8F.

Figure 8H:
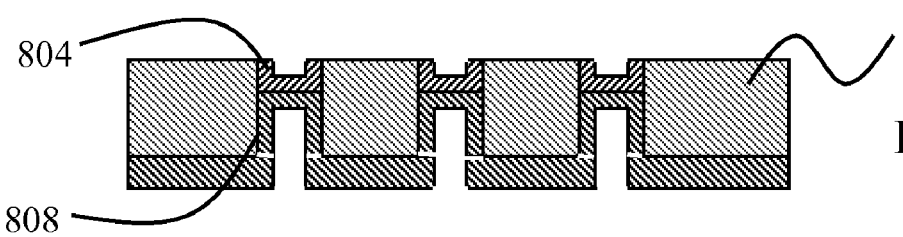
Figure 8I:
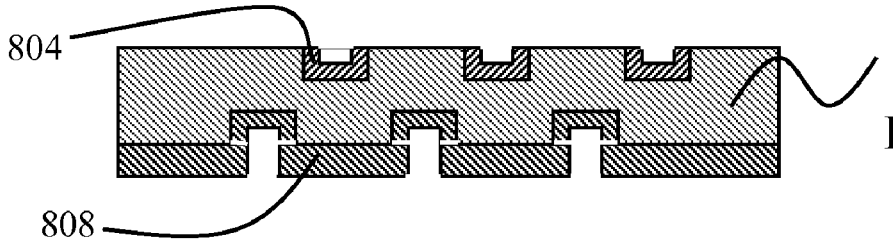
Figure 8J:
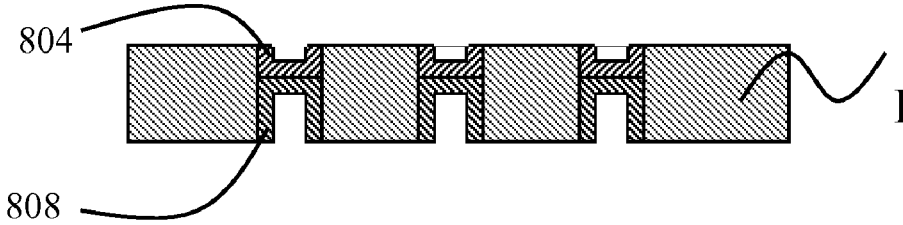
Figure 8K:
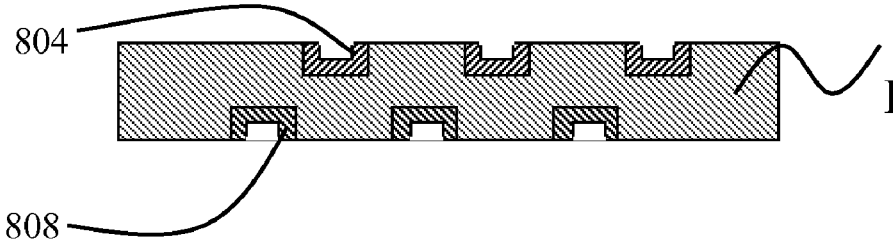
Figure 8L:
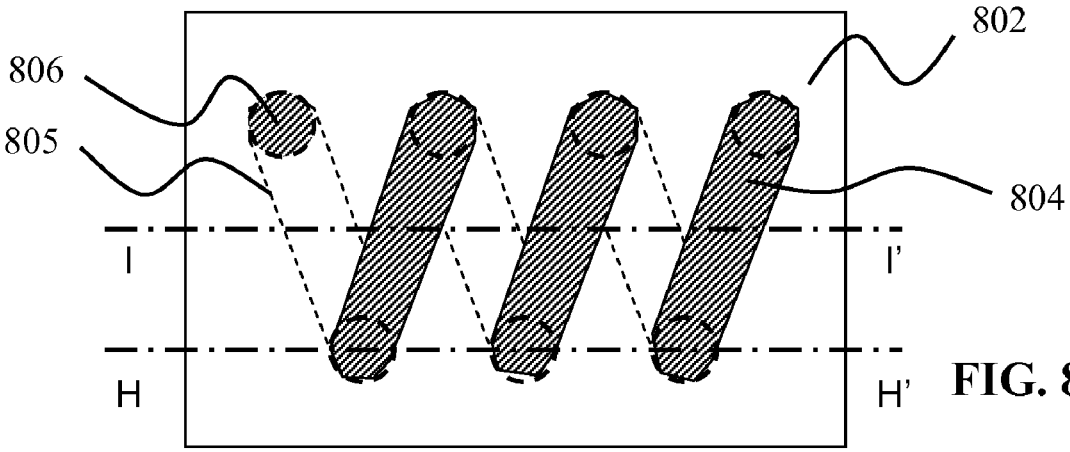
FIG. 8L is a top transparent view of the completed power inductor.

Subsequent fabrication may proceed as depicted in FIGS. 8H-8K. The cross-sections in FIG. 8H and FIG. 8J are taken along line H-H' of FIG. 8L. The cross-sections depicted in FIG. 8I and FIG. 8K are taken along line I-I' of FIG. 8L. Conductive material 808 is deposited on the bottom surface of the substrate 802 in a way that partially fills the grooves 805 and vias 806 as shown on FIGS. 8H-8I. The conductive material 808 is etched back, e.g., using dry etching or chemical mechanical polishing (CMP) to planarize the surface (and expose the ferrite spaced away from the grooves and vias) as shown in FIGS. 8J-8K.

Multiple inductors may be fabricated on a single sheet of ferrite material using the technique illustrated in FIGS. 8A-8K. After the inductors have been formed, the sheet may be singulated into individual inductor chips using standard dicing technology.

Figure 9A:
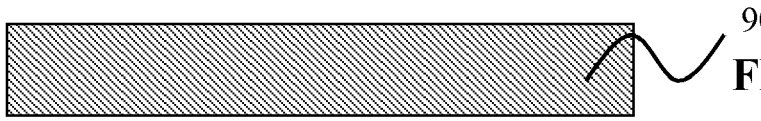
FIGS. 9A-9B, 9D-9E, 9G, 9I, and 9K-9N are cross-sectional views illustrating a method for manufacturing a power inductor of the type depicted in FIG. 3A.
Figure 9B:
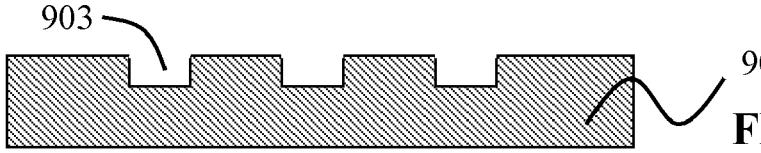
Figure 9C:
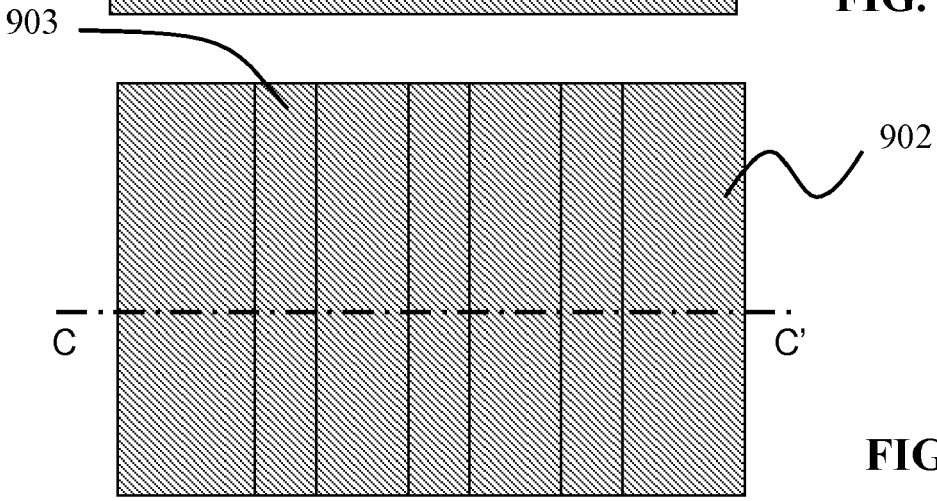
FIG. 9C is a top view of a partially completed inductor structure at the fabrication stage depicted in FIG. 9B.

FIGS. 9A-9B, 9D-9E, 9G and 9I, 9K-9N are cross-sectional views illustrating a method for manufacturing a power inductor with grooves that extend across the surfaces of the ferrite substrate from one edge to another edge and filled with conductive material as depicted in FIGS. 3A-3F. FIGS. 9C and 9F show top views of a partially completed inductor. FIGS. 9H and 9J show bottom views of a partially completed inductor. FIG. 9O shows a top view of a completed inductor. As shown in FIG. 9A, a magnetic core substrate 902 is provided, which is preferably a ferrite that is optimized for high frequency, such as NiZn and the like. The top surface of the substrate 902 is cut with a saw to form straight and parallel top grooves 903 as shown in FIG. 9B and FIG. 9C. The cross-section in FIG. 9B is taken along line C-C' of FIG. 9C.

Figure 9D:
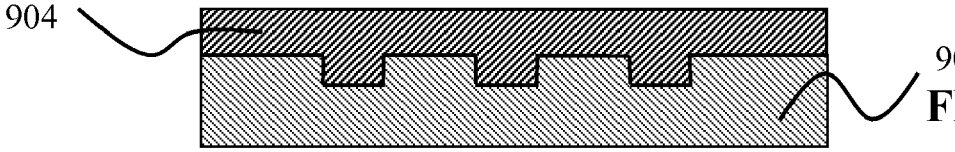
Figure 9E:
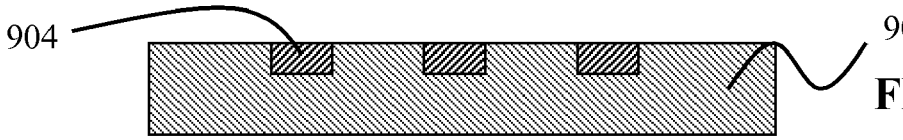
Figure 9F:
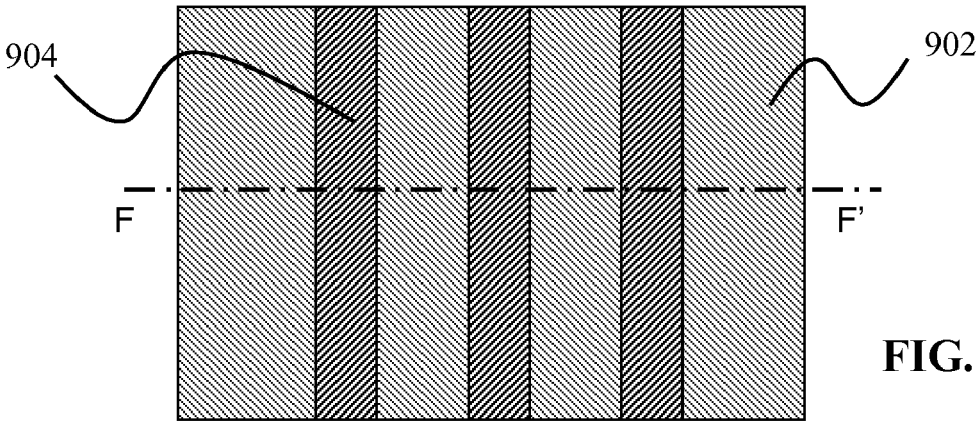
FIG. 9F is a top view of a partially completed inductor structure at the fabrication stage depicted in FIG. 9E.

Conductive material 904, for example metal such as W, copper, Al, Ag and the like, is then deposited on top of the substrate 902, completely filling the grooves 903 as shown in FIG. 9D. The conductive material 904 is etched back down to the top surface of the magnetic substrate 902 as shown in FIG. 9E and FIG. 9F. The cross-sections in FIGS. 9D-9E are taken along line F-F' of FIG. 9F.

Figure 9G:
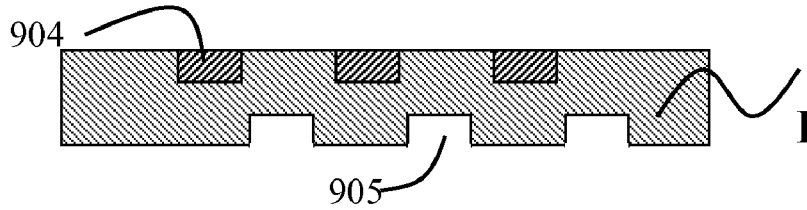
Figure 9H:
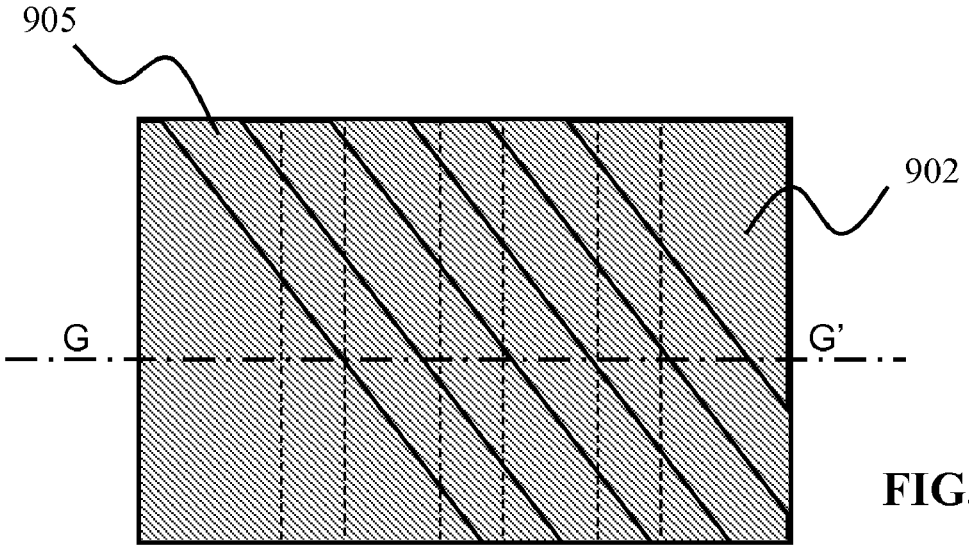
FIG. 9H is a bottom view of a partially completed inductor structure at the fabrication stage depicted in FIG. 9G.

The substrate 902 is then flipped over and rotated to an angle α (α<90°), which is a function of the width of the inductor. The surface of the substrate 902 is sawed to form bottom grooves 905 that are at an angle α relative to the conductor filled top grooves 903 on the top side as shown in FIG. 9G. FIG. 9H is a bottom view of the structure shown in FIG. 9G. The cross-section in FIG. 9G is taken along line G-G' of FIG. 9H. The bottom view of FIG. 9H is taken by flipping the substrate 902 of FIG. 9F over from top to bottom, i.e., about line F-F'.

Figure 9I:
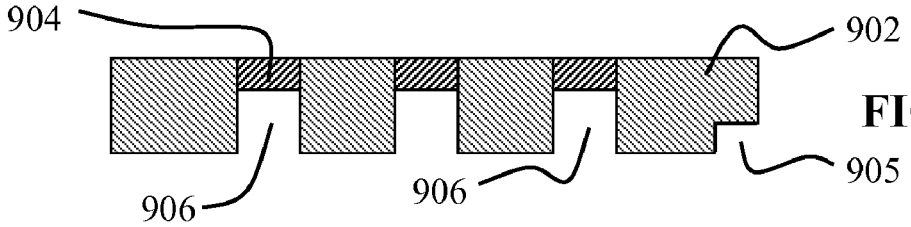
Figure 9J:
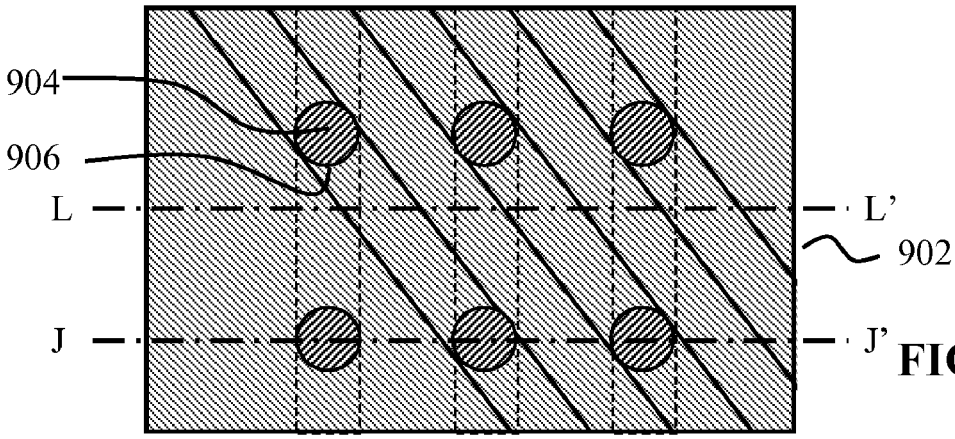
FIG. 9J is a bottom view of a partially completed inductor structure at the fabrication stage depicted in FIG. 9I.

Vias 906 are patterned on the bottom surface of the substrate 902 and are formed by spinning resist, exposing mask and developing, and etching the substrate 902 to an end point when the bottom of the conductive material 904 in the top grooves 903 is exposed as shown in FIG. 9I. FIG. 9J is a bottom view of the structure depicted in FIG. 9I. The cross-section in FIG. 9I is taken along line J-J' of FIG. 9J.

Figure 9K:
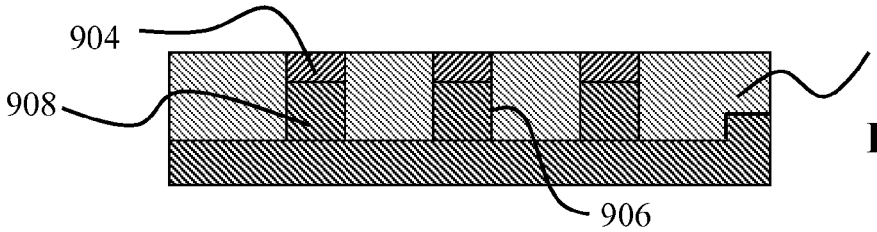
Figure 9L:
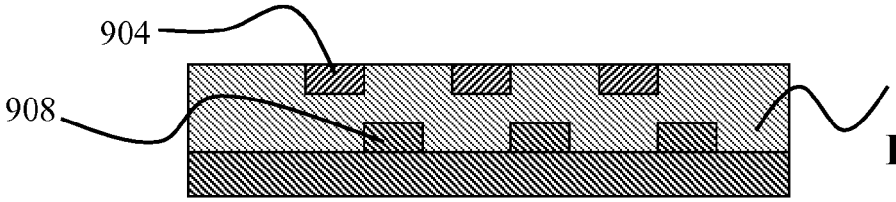

Conductive material 908 is deposited on the bottom surface of the substrate 902 and is filled into the bottom grooves 905 and vias 906 as shown in FIGS. 9K-9L. The cross-section in FIG. 9K is taken along line J-J' in FIG. 9J. The cross-section in FIG. 9L is taken along line L-L' in FIG. 9J.

Figure 9M:
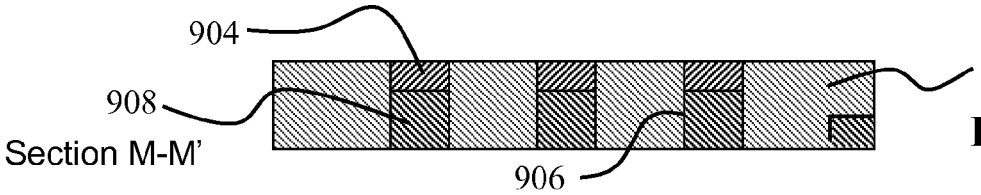
Figure 9N:
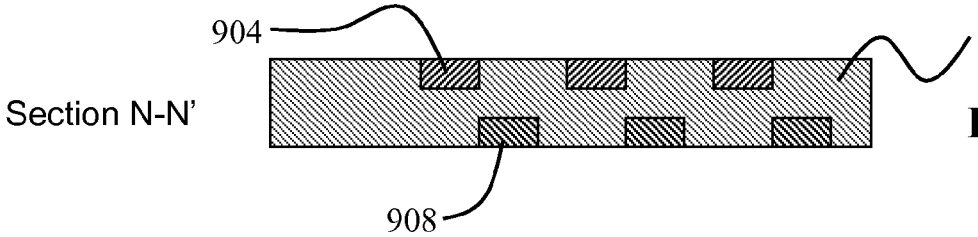
Figure 9O:
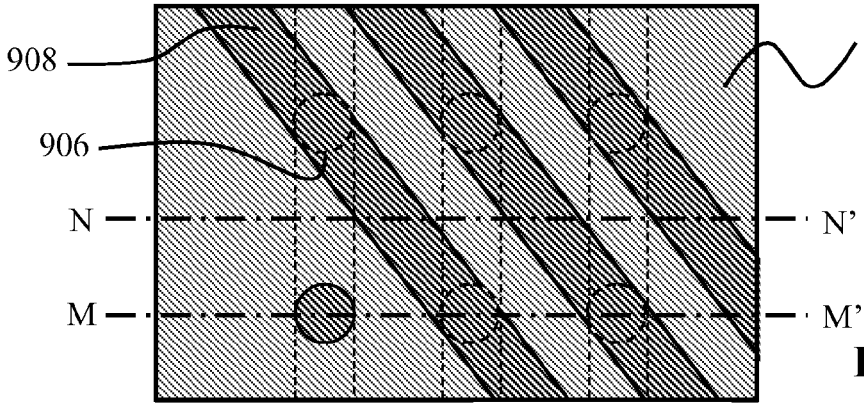
FIG. 9O is a bottom view of the completed power inductor.

The conductive material 908 is etched back using dry etching back or chemical mechanical polishing (CMP) to planarize the surface and expose the ferrite material spaced away from the grooves and vias, as shown in FIGS. 9M-9N. FIG. 9O is a bottom view of a complete inductor structure. The cross-section in FIG. 9M is taken along line M-M' in FIG. 9O. The cross-section in FIG. 9N is taken along line N-N' in FIG. 9O.

FIGS. 10A-10J are top and bottom views illustrating a method for manufacturing multiple power inductors of the type depicted in FIGS. 3A-F in a single sheet of ferrite material.

Figure 10A:
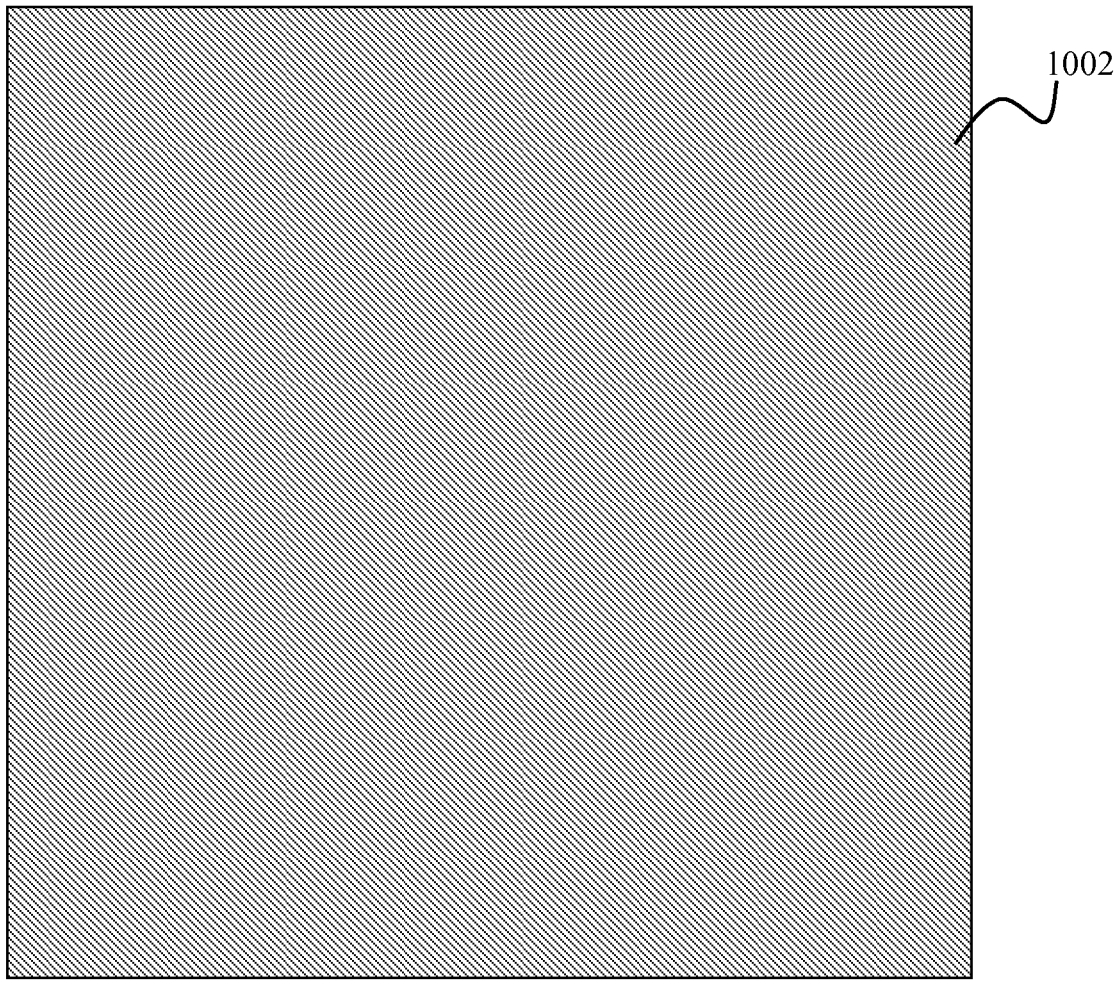
FIGS. 10A-10D are a sequence of top views and FIGS. 10E-10I are a sequence of bottom views illustrating a method for manufacturing multiple power inductors of the type depicted in FIG. 3A from a single sheet of ferrite material according to an embodiment of the present invention.
Figure 10B:
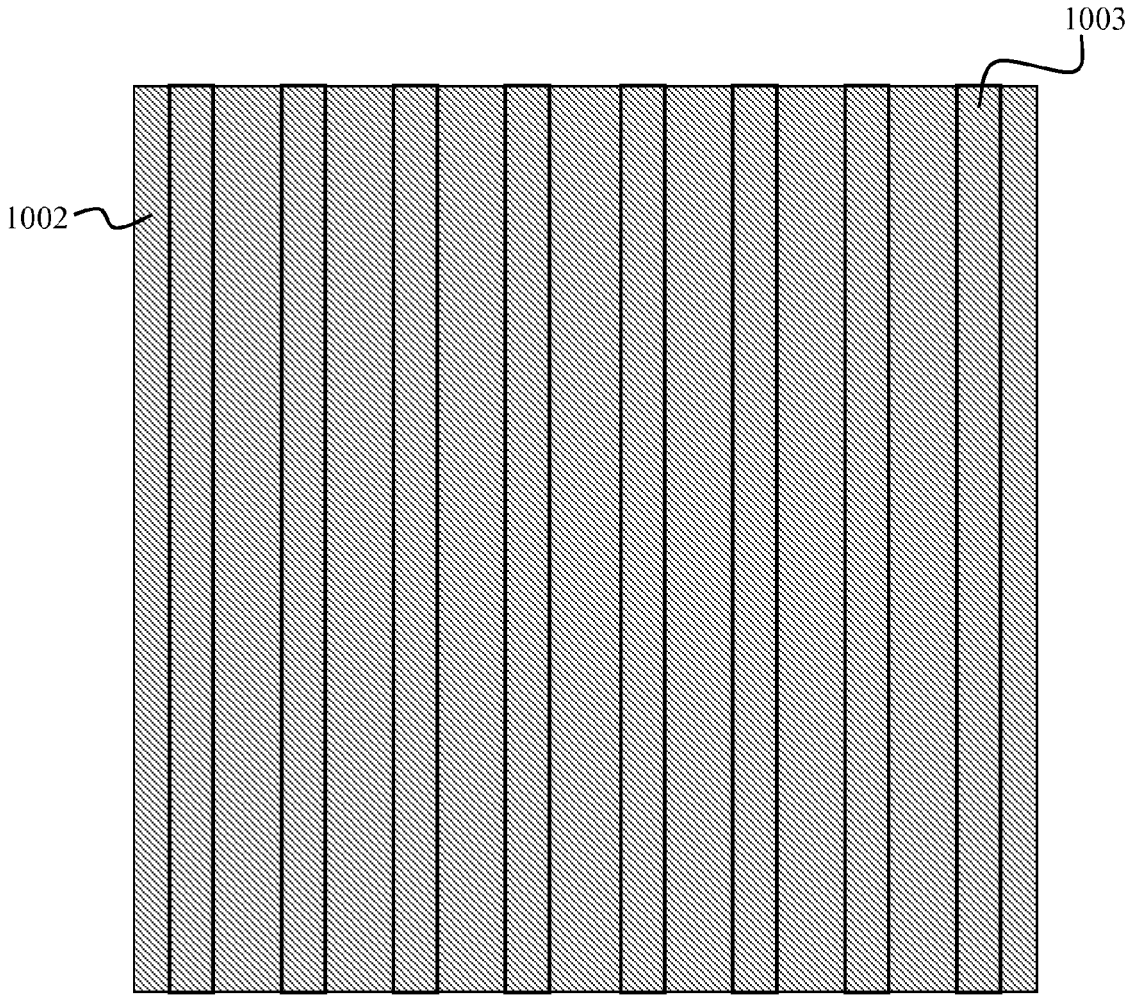
Figure 10C:
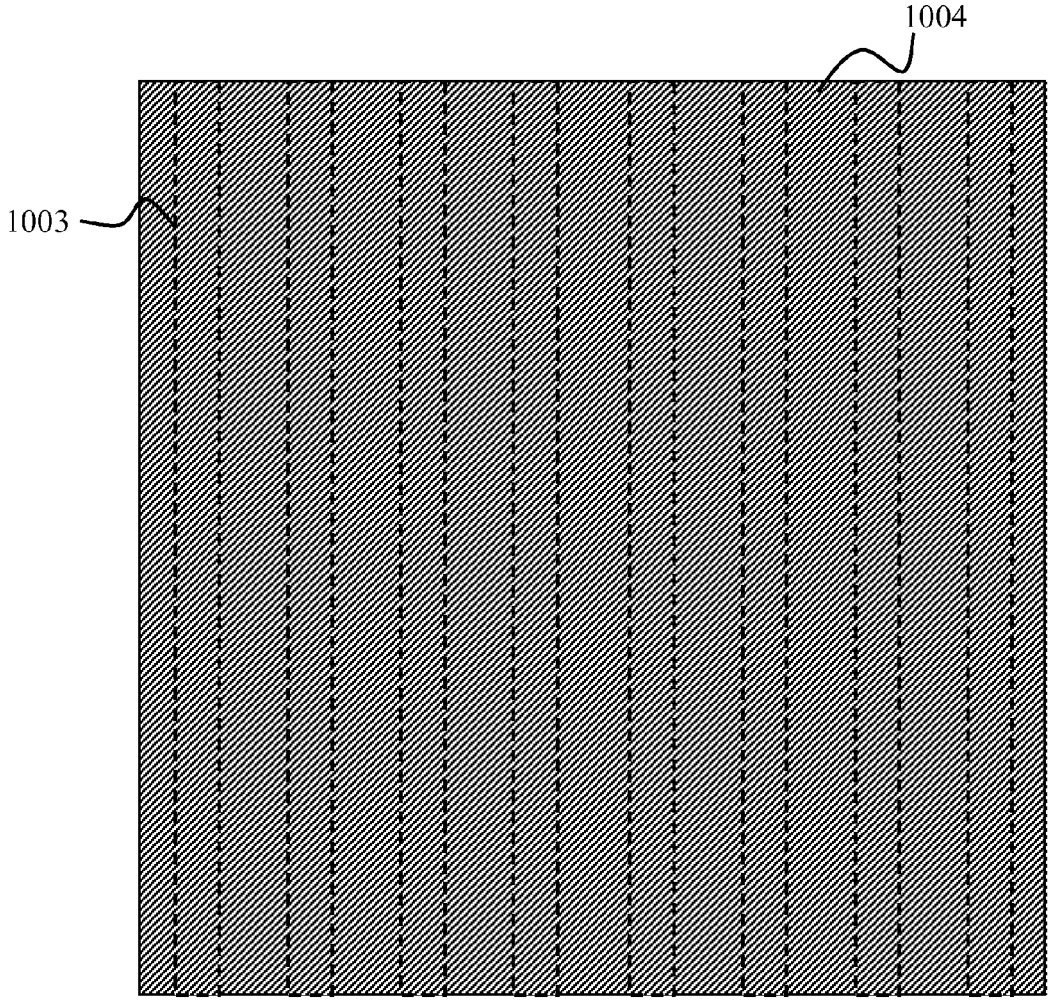
Figure 10D:
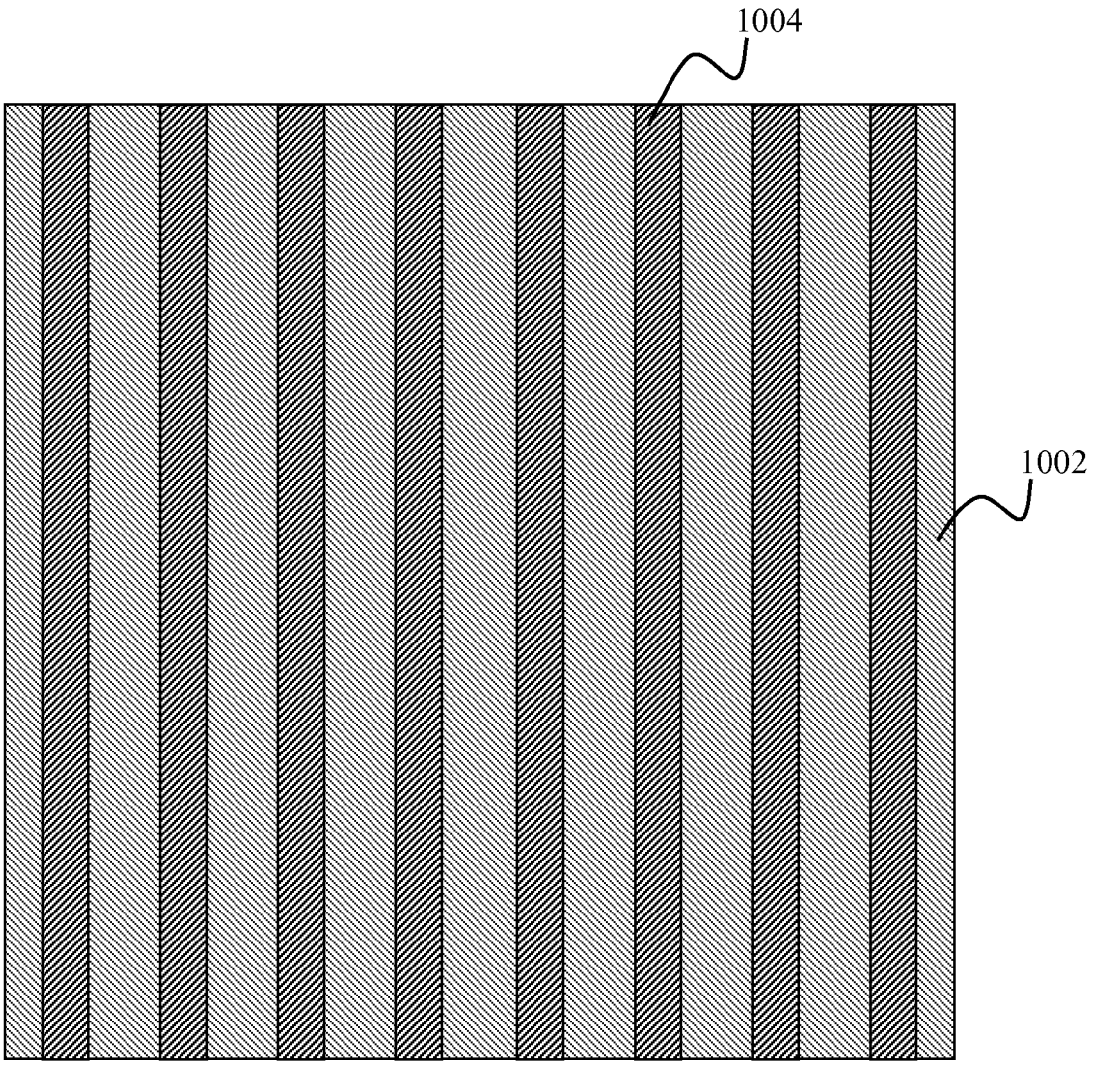

FIGS. 10A-10D are top views of the ferrite sheet 1002. As shown in FIG. 10A, a single sheet of ferrite material 1002 is provided. Preferably, the substrate 1002 is a ferrite optimized for high frequency, such as NiZn and the like. The top surface of the substrate 1002 is cut, e.g., by shallow saw cuts, to form top grooves 1003. Conductive material 1004, for example a metal such as tungsten (W), copper (Cu), aluminum (Al), silver (Ag) and the like, is then deposited on top of the ferrite sheet 1002, e.g., by a vapor deposition technique, such as chemical vapor deposition (CVD). The conductive material 1004 may completely fill the top grooves 1003 as shown in FIG. 10C. Excess conductive material 1004 may be etched back, e.g., using dry etching or chemical mechanical polishing (CMP) to planarize the surface and expose the ferrite spaced away from the grooves and via regions, as shown in FIG. 10D.

Figure 10E:
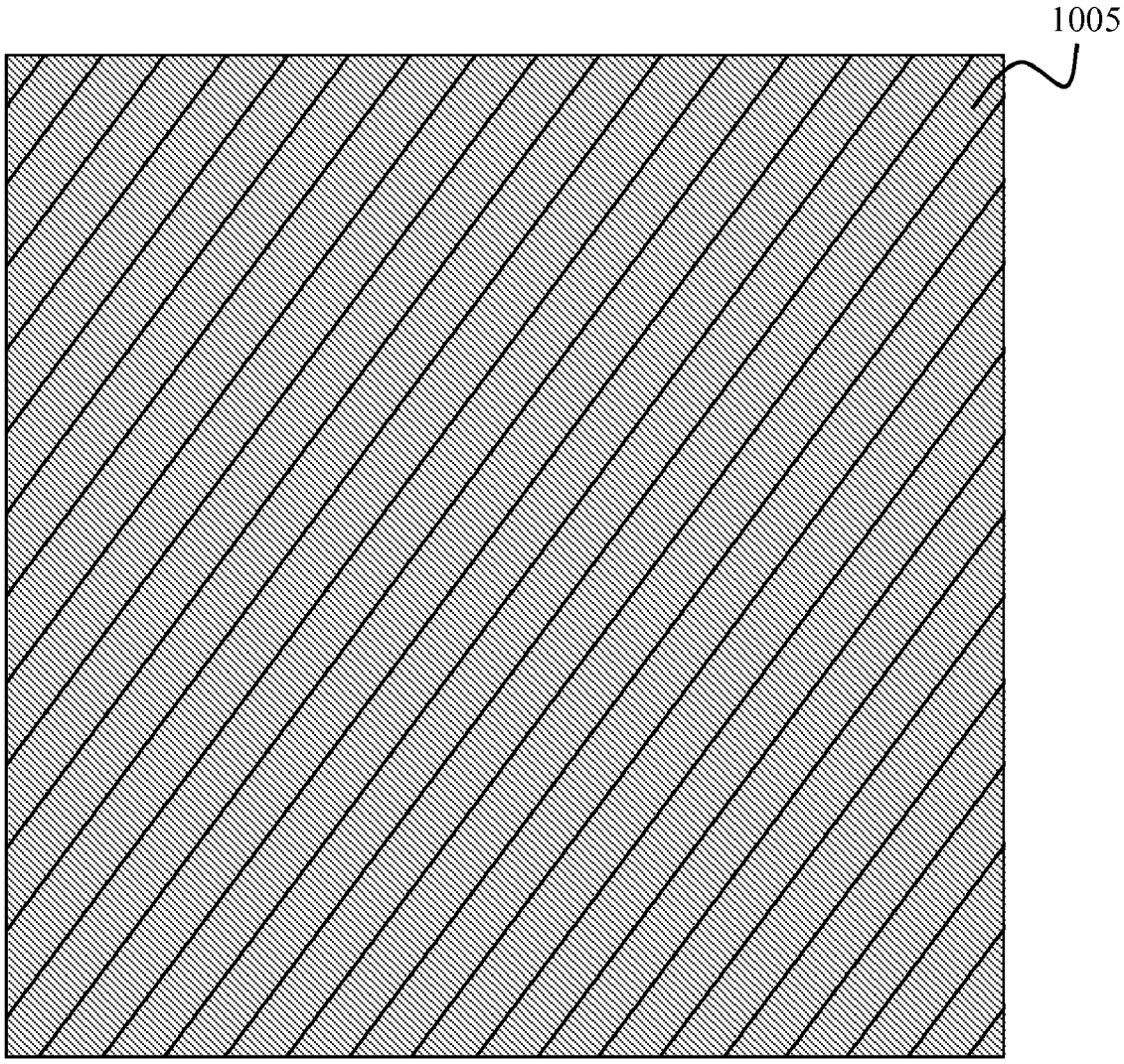

A fabrication sequence similar to that carried out on the top surface of the ferrite sheet 1002 may be repeated on the bottom surface. For example, FIGS. 10E-10I are a sequence of bottom views illustrating subsequent processing of the ferrite sheet 1002. Specifically, the ferrite sheet 1002 is flipped over, and bottom grooves 1005 are cut on the bottom surface, e.g., by shallow saw cuts, as shown in FIG. 10E.

Figure 10F:
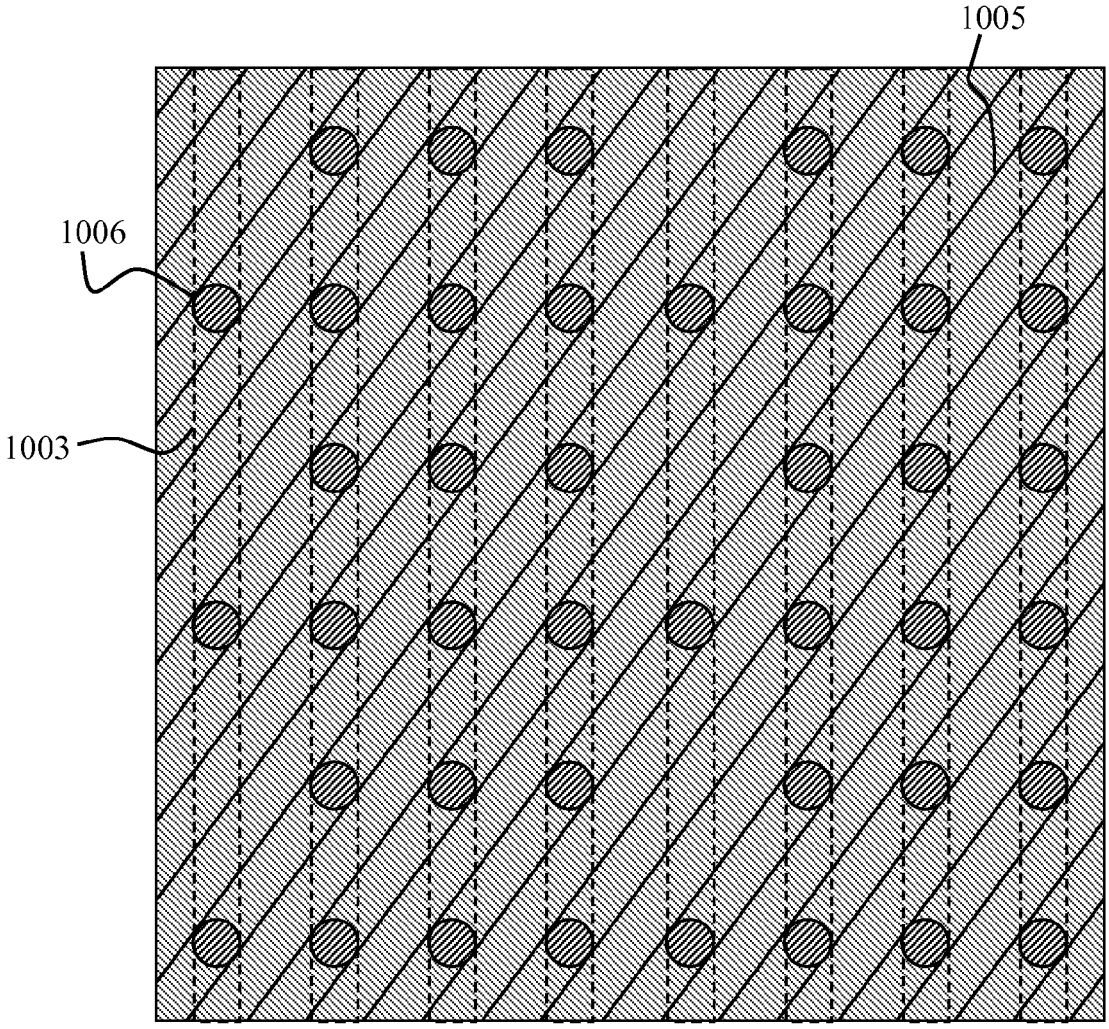

Vias 1006 are patterned and etched on the bottom surface of the ferrite sheet 1002 at certain locations where the top and bottom grooves 1003, 1005 overlap. The vias 1006 may be formed, e.g., by etching through the substrate down to the conductive material 1004 of the top surface as shown in FIG. 10F using a patterned etching technique. The locations of the top grooves 1003 are indicated by dashed lines in FIG. 10F.

Figure 10G:
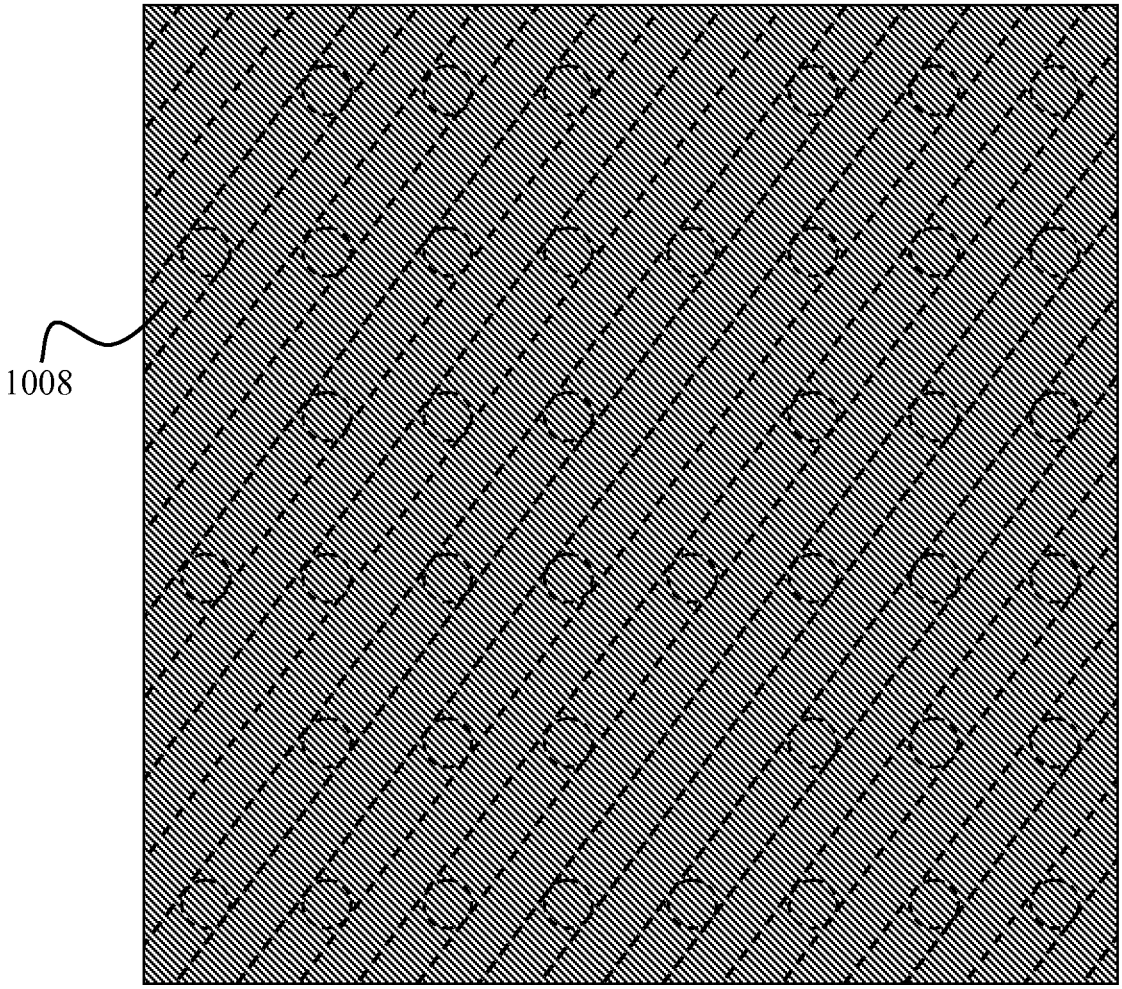

Conductive material 1008 is deposited on the bottom surface of the ferrite sheet 1002, completely filling the grooves 1005 and vias 1006 as shown in FIG. 10G. The conductive material 1008 may be etched back, e.g., using dry etching back or chemical mechanical polishing (CMP) to planarize the surface and exposed the ferrite spaced away from the grooves and via regions, as shown in FIG. 10H.

Figure 10H:
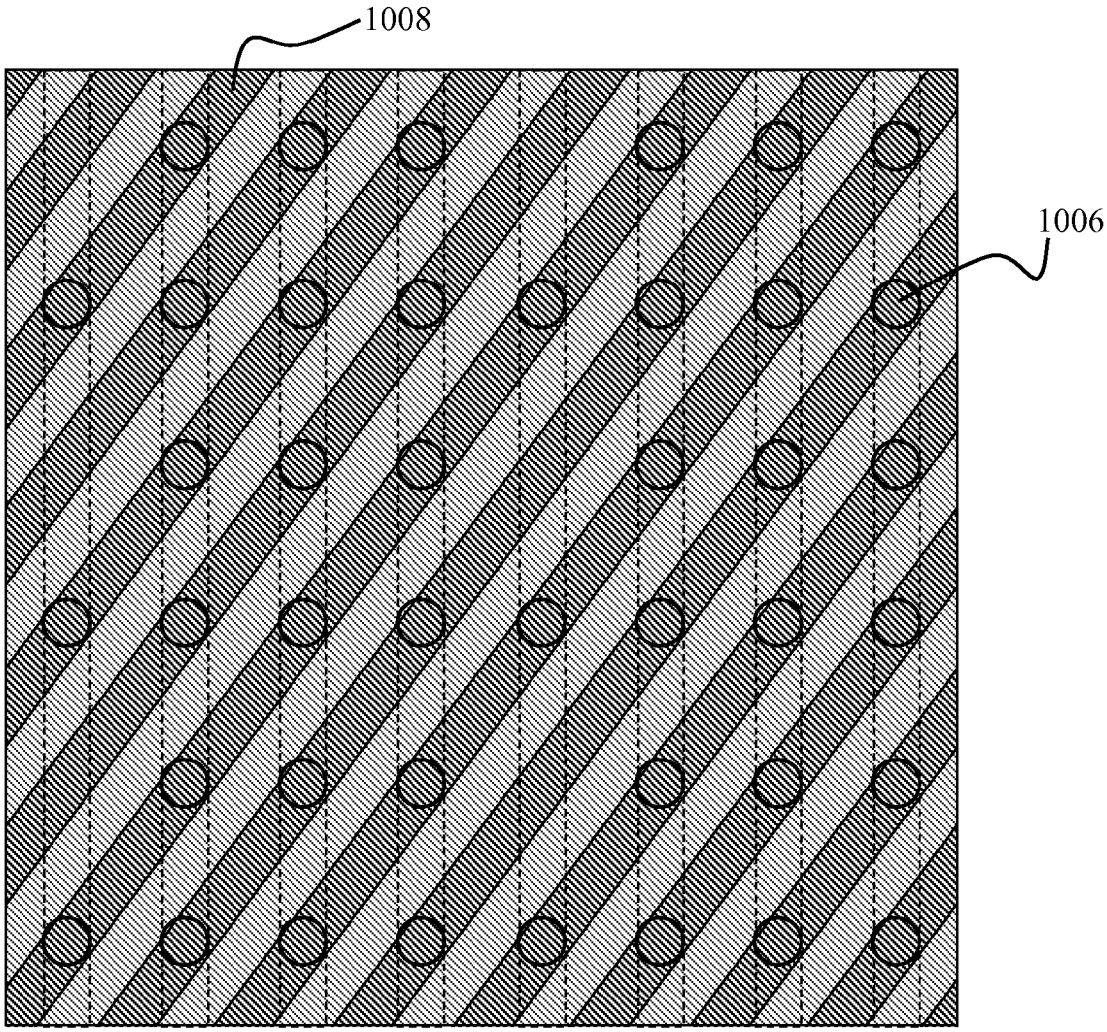
Figure 10I:
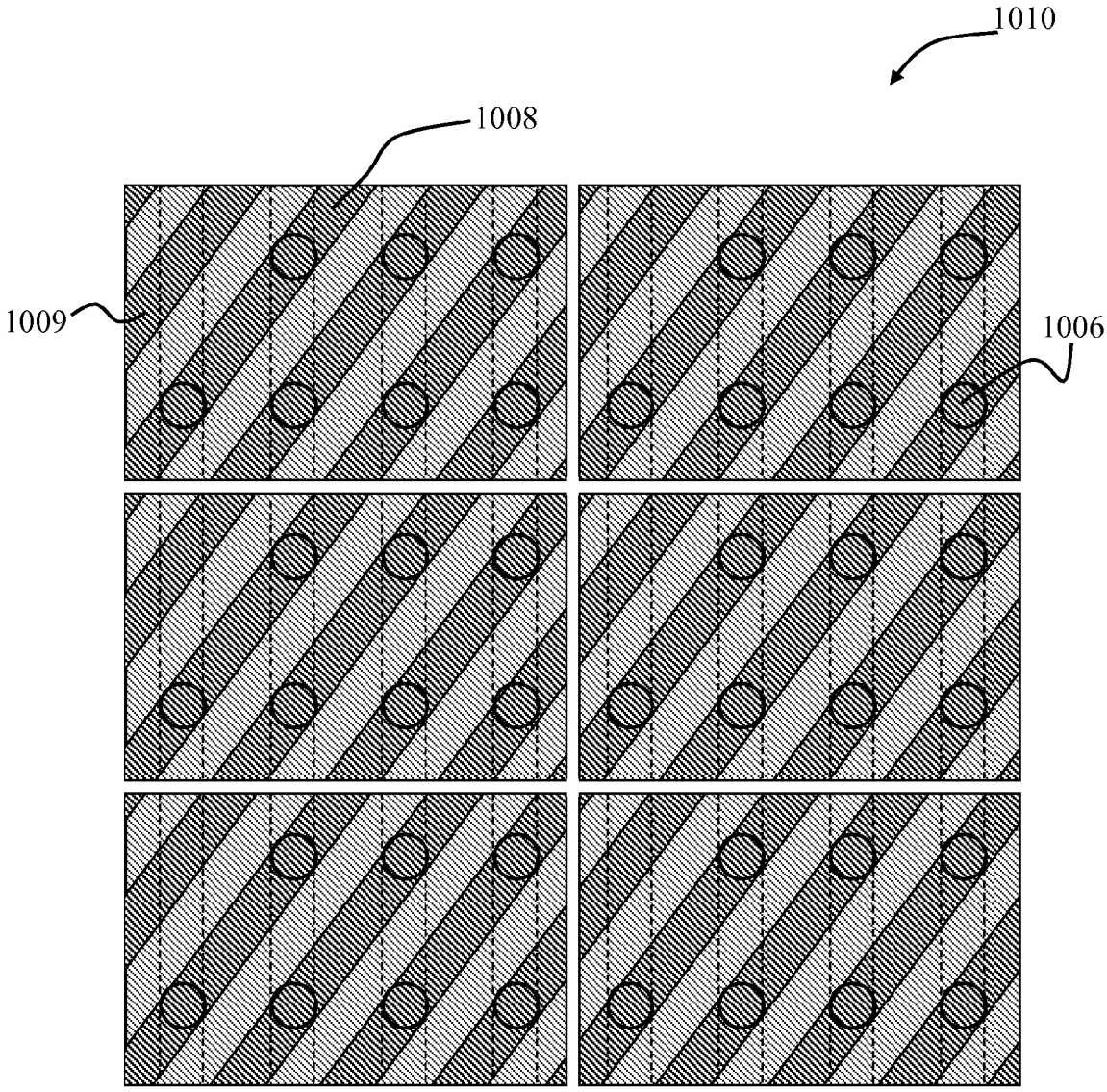
Figure 10J:
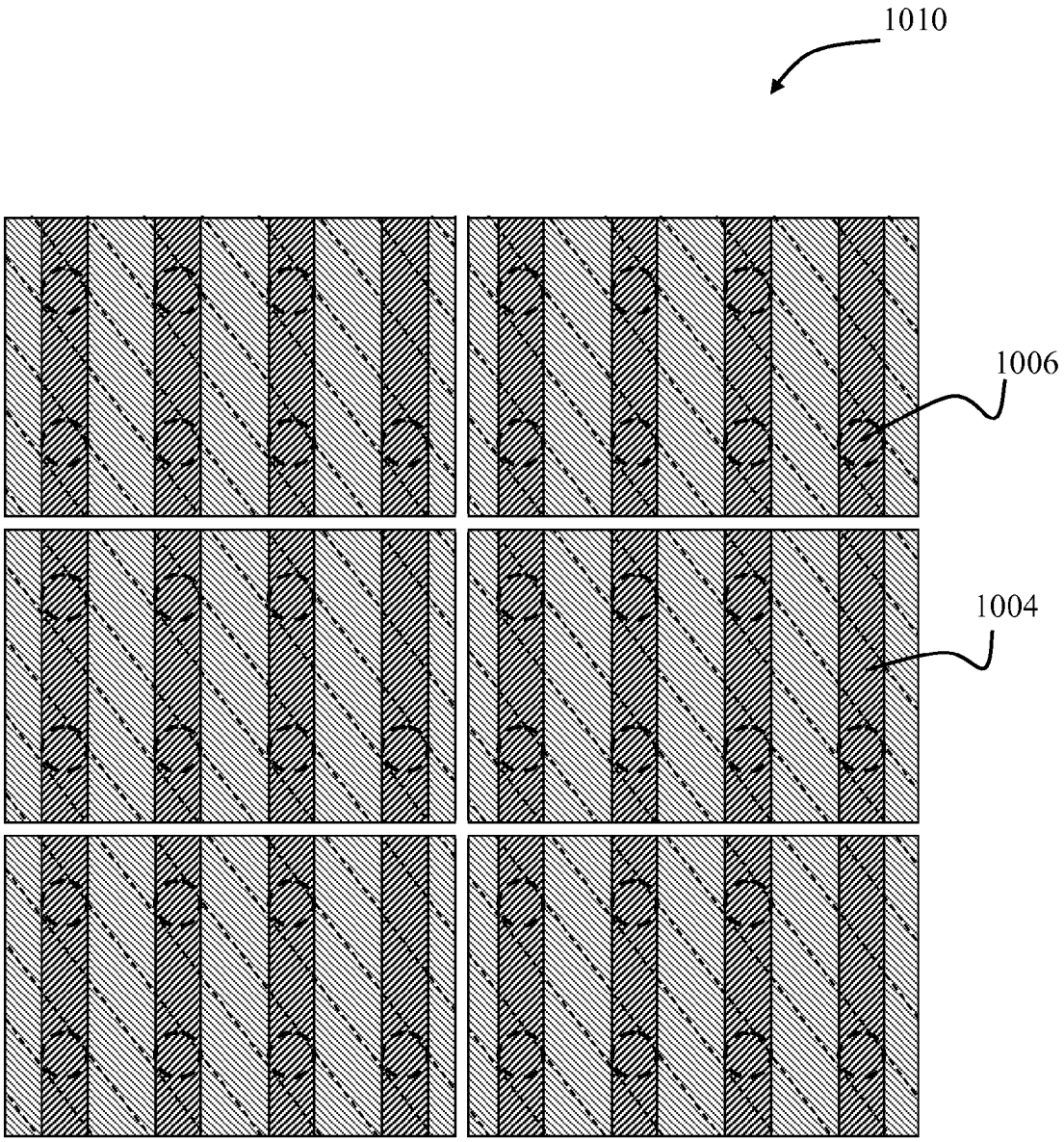
FIG. 10J is a top view illustrating a plurality of inductors singulated from a single sheet of ferrite material by the method illustrated in FIGS. 10A-10I.

After the inductors have been formed as shown in FIG. 10H, the ferrite sheet 1002 may be singulated into individual inductor chips 1010 using standard dicing technology. FIG. 10J is a bottom view of diced completed inductors 1010. FIG. 10J is a top view of diced completed inductors 1010. The top view in FIG. 10J is taken by flipping the ferrite sheet 1002 over from left to right. The ferrite sheet 1002 with the filled grooves and vias may be subjected to an optional annealing stage, e.g., as described above, prior to singulation of the sheet into individual inductors 1010, each having an inductor coil and a ferrite core. The position and alignment of the top and bottom grooves 1003, 1005, need to be selected carefully to allow the grooves of many individual inductors 1010 to be sawed on a single ferrite substrate. As can be seen in the FIG. 10J the shallow saw cuts that form the grooves in the inductors 1010 might include grooves for extra floating conductors 1009 that are not part of the inductor coils. These extra conductors need not be electrically connected to any other part of the inductor, and do not affect the operation of the inductors 1010.

Multiple inductors may alternatively be fabricated on a single sheet of ferrite material using the technique illustrated in FIGS. 7A-7K. Inductors according to all the embodiments in this invention may be fabricated as multiple inductors on a single sheet of ferrite material. After the inductors have been formed, the sheet may be singulated into individual inductor chips using standard dicing technology.

The methods described above in FIGS. 7A-7L and 8A-8L, 9A-9O and 10A-10J can optionally include a dielectric deposition step prior to the masking and etching of the grooves to form the inductor of the type depicted in FIGS. 4A-4E. The material of the dielectric layer can be can be LTO, PECVD Oxide, Si rich oxide, Silicon oxy-nitride, Silicon nitride, aluminum nitride, aluminum oxide, polyimide, benzocyclobutene (BCB), etc. . . with a thickness of 500 A to 5 microns. The dielectric layer is then etched prior to the etching or sawing of the magnetic material on the surface of the magnetic core substrate to form the grooves.

Alternatively, methods described above in FIGS. 7A-7L and 8A-8L, 9A-90 and 10A-10J can be added a deposition step of magnetic material which passivates the surface of the magnetic core substrate after the step of etching back of the conductive material in the grooves to planarize the surface. The material of magnetic material layer can be epoxy with ferrite powders, dielectric with magnetic particles, etc. . . . with a thickness of 500 Angstroms to 5 microns or more. A dielectric etch step also can be added prior to the etching of the magnetic material.

The inductors of the present invention have planar structure and with ultra-low resistance, high inductance per unit area and compatible with stacked Power-IC on Inductor concept. The methods for making the inductors of the present invention are low-cost and can be implemented with a single magnetic core layer.

While ferrite is the preferred material for the inductor core because of its high permeablility and high electric resistivity, other equivalent materials may be used. For example NiFe can be used for low frequency applications. Other materials having low resistivity may possibly be used if all its surfaces are passivated prior to depositing conductive materials to form the inductor coil. In this text the term 'ferrite' is understood to include other equivalent materials.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature, whether preferred or not, may be combined with any other feature, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. An inductor comprising:

a planar ferrite core;

a first group of one or more grooves formed in a first side of the ferrite core;

a second group of two or more grooves formed in a second side of the ferrite core, wherein the grooves in the first and second groups are oriented such that each groove in the first group overlaps with one or two corresponding grooves in the second group;

a first plurality of vias communicating through the ferrite core between the first and second sides of the ferrite core, wherein each via is located where a groove in the first group overlaps with a groove in the second group; and a conductive material disposed in the first and second groups of grooves and the vias, wherein the conductive material disposed in the first and second groups of grooves and the vias form an inductor coil.

2. The inductor of claim 1, wherein the inductor is planar.

3. The inductor of claim 1, wherein the ferrite core forms a closed magnetic loop around the inductor coil.

4. The inductor of claim 1, further comprising a via located at an end of the inductor coil at one of the first and second sides of ferrite core, wherein the via communicates between the end of the inductor coil and the other of the first and second sides of the ferrite core.

5. The inductor of claim 1, wherein the inductor coil thickness is a function of the groove depth.

6. The inductor of claim 1, wherein the first group of one or more grooves includes two or more parallel grooves.

7. The inductor of claim 1, wherein the second group of two or more grooves includes two or more parallel grooves.

8. The inductor of claim 1, wherein each via in the first plurality communicates between a groove in the first group of one or more grooves and a groove in the second group of two or more grooves.

9. The inductor of claim 1, further comprising one or more additional vias in a second plurality of vias communicating between the first side and the second side of the ferrite core.

10. The inductor of claim 1 wherein the conductive material fills the grooves and vias.

11. The inductor of claim 1 wherein the conductive material partially fills the grooves and vias.

12. The inductor of claim 11 wherein the conductive material lines a bottom and sidewalls of the grooves and sidewalls of the vias.

13. The inductor of claim 1 wherein the grooves in the first or second group extend all the way across the ferrite core.

14. The inductor of claim 1 wherein the first pluralities of vias is located away from the edges of the ferrite core.

15. The inductor device of claim 1 wherein the ferrite core includes a first ferrite layer including the first side and a second ferrite layer including the second side, wherein the first and second ferrite layers are attached to each other back to back such that the first and second sides are disposed on outside surfaces of the ferrite core.

16. The inductor device of claim 1, further comprising a dielectric layer passivating the first or second side of the ferrite core.

17. The inductor of claim 1 wherein the conductive material does not extend outside the plane of the ferrite core's surfaces.

* * * * *